US010555581B2

(12) United States Patent
Bruce et al.

(10) Patent No.: US 10,555,581 B2
(45) Date of Patent: Feb. 11, 2020

(54) BRAIDED UPPER WITH MULTIPLE MATERIALS

(71) Applicant: NIKE, Inc., Beaverton, OR (US)

(72) Inventors: Robert M. Bruce, Portland, OR (US); Eun Kyung Lee, Beaverton, OR (US); Craig K. Sills, Tigard, OR (US)

(73) Assignee: Nike, Inc., Beaverton, OR (US)

( * ) Notice: Subject to any disclaimer, the term of this patent is extended or adjusted under 35 U.S.C. 154(b) by 535 days.

(21) Appl. No.: 14/721,450

(22) Filed: May 26, 2015

(65) Prior Publication Data

US 2016/0345674 A1 Dec. 1, 2016

(51) Int. Cl.
*A43B 23/02* (2006.01)
*D04C 3/48* (2006.01)

(52) U.S. Cl.
CPC ..... *A43B 23/0245* (2013.01); *A43B 23/021* (2013.01); *A43B 23/0215* (2013.01); *D04C 3/48* (2013.01)

(58) Field of Classification Search
CPC ..... D04C 1/06; D04C 3/48; A43B 23/0245; A43B 23/0265
See application file for complete search history.

(56) References Cited

U.S. PATENT DOCUMENTS

| | | | |
|---|---|---|---|
| 165,941 | A | 7/1875 | Malhere |
| 329,739 | A | 11/1885 | Henkels |
| 376,372 | A | 1/1888 | Dodge et al. |
| 509,241 | A | 11/1893 | Packard |
| 578,294 | A | 3/1897 | Leayitt |
| 586,137 | A | 7/1897 | Medger |
| 621,922 | A | 3/1899 | Kelsall |
| 1,182,325 | A | 5/1916 | Sedmak |
| 1,318,888 | A | 10/1919 | Le Carpentier |
| 1,527,344 | A | 2/1925 | Bente et al. |
| 1,538,160 | A | 5/1925 | Bosebeck |
| 1,540,903 | A | 6/1925 | Santoyo |
| 1,554,325 | A | 9/1925 | Bente |
| 1,583,273 | A | 5/1926 | Bosebeck |
| 1,597,934 | A | 8/1926 | Stimpson |
| 1,600,621 | A | 9/1926 | Buek, Jr. |
| 1,622,021 | A | 3/1927 | Birkin et al. |

(Continued)

FOREIGN PATENT DOCUMENTS

| | | | |
|---|---|---|---|
| BE | 426458 | A1 | 3/1938 |
| CN | 86209002 | B | 10/1987 |

(Continued)

OTHER PUBLICATIONS

International Search Report and Written Opinion dated Sep. 23, 2016 in International Application No. PCT/2016/034109, 18 pages.

(Continued)

*Primary Examiner* — Shaun R Hurley
(74) *Attorney, Agent, or Firm* — Shook, Hardy & Bacon L.L.P.

(57) ABSTRACT

An article of footwear is formed from multiple braided components. The braided components may be braided strands formed from different tensile elements. The tensile elements may have different cross-sections. The tensile elements may be from different materials. Different braided strands may then be over-braided over a last to form a braided upper for the article of footwear.

15 Claims, 13 Drawing Sheets

(56) References Cited

U.S. PATENT DOCUMENTS 1,637,716 A 8/1927 Turck
1,663,319 A 3/1928 Snell
1,687,643 A 10/1928 Berliner
1,713,307 A 5/1929 Stritter
1,717,183 A 6/1929 Brenner
1,803,554 A 5/1931 Knilans
1,828,320 A 10/1931 Daniels
1,832,691 A 11/1931 David
1,864,254 A 6/1932 Meyer
1,877,080 A 9/1932 Teshima
1,887,643 A 11/1932 Huber
1,949,318 A 2/1934 Markowsky
D91,999 S 4/1934 Heilbrunn
2,001,293 A 5/1935 Wallace
2,022,350 A 11/1935 Huber
2,091,215 A 8/1937 Price
2,144,689 A 1/1939 Roberts
2,147,197 A 2/1939 Glidden
2,161,472 A 6/1939 Hurwit
2,162,472 A 6/1939 Lou
2,165,092 A 7/1939 Daniels
2,188,640 A 1/1940 Bloch et al.
RE21,392 E 3/1940 Hurwit
2,271,888 A 2/1942 Manley
2,311,959 A 2/1943 Nurk
D137,767 S 4/1944 Goldstein
2,382,559 A 8/1945 Goldstein
2,412,808 A 12/1946 Goldstein
2,521,072 A 9/1950 Lovell
D164,847 S 10/1951 Dronoff
2,586,045 A 2/1952 Hoza
2,617,129 A 11/1952 Petze
2,641,004 A 6/1953 Whiting et al.
2,675,631 A 4/1954 Carr
2,679,117 A 5/1954 Reed
2,701,887 A 2/1955 Nolan
2,936,670 A 5/1960 Erwin
3,052,904 A 9/1962 Reid et al.
3,257,677 A 6/1966 Batchelder et al.
3,282,757 A 11/1966 Brussee
3,397,847 A 8/1968 Thaden
3,474,478 A 10/1969 Batchelder et al.
3,504,450 A 4/1970 Steadman et al.
3,525,110 A 8/1970 Rubico
3,586,058 A 6/1971 Ahrens et al.
3,619,838 A 11/1971 Winkler
3,745,600 A 7/1973 Rubico et al.
3,805,667 A 4/1974 Orser
3,821,827 A 7/1974 Nadler
4,134,955 A 1/1979 Hanrahan, Jr. et al.
4,149,249 A 4/1979 Pavkovich
4,222,183 A 9/1980 Haddox
4,232,458 A 11/1980 Bartels
4,275,638 A 6/1981 DeYoung
4,341,097 A 7/1982 Cassidy et al.
4,351,889 A 9/1982 Sundberg
4,394,803 A 7/1983 Goldstein
4,430,811 A 2/1984 Okada
4,447,967 A 5/1984 Zaino
4,519,290 A 5/1985 Inman et al.
4,587,749 A 5/1986 Berlese
4,591,155 A 5/1986 Adachi
4,629,650 A 12/1986 Kataoka
4,640,027 A 2/1987 Berlese
4,719,837 A 1/1988 McConnell et al.
4,785,558 A 11/1988 Shiomura
4,847,063 A 6/1989 Smith
4,848,745 A 7/1989 Bohannan et al.
4,857,124 A 8/1989 Shobert et al.
4,882,848 A 11/1989 Breyer et al.
4,885,973 A 12/1989 Spain
4,916,997 A 4/1990 Spain
4,919,388 A 4/1990 Koike et al.
4,974,275 A 12/1990 Backes et al.
4,976,812 A 12/1990 McConnell et al.
4,992,313 A 2/1991 Shobert et al.
5,001,961 A 3/1991 Spain
D315,823 S 4/1991 Signori
5,067,525 A 11/1991 Tsuzuki et al.
5,121,329 A 6/1992 Crump et al.
5,201,952 A 4/1993 Yahagi et al.
5,203,249 A 4/1993 Adams et al.
5,257,571 A 11/1993 Richardson
5,287,790 A 2/1994 Akiyama et al.
5,335,517 A 8/1994 Throneburg et al.
5,345,638 A 9/1994 Nishida
5,348,056 A 9/1994 Tsuzuki
5,361,674 A 11/1994 Akiyama et al.
5,381,610 A 1/1995 Hanson
5,388,497 A 2/1995 Akiyama et al.
5,396,829 A 3/1995 Akiyama et al.
5,398,586 A 3/1995 Akiyama et al.
5,439,215 A 8/1995 Ratchford
5,476,027 A 12/1995 Uchida et al.
5,647,150 A 7/1997 Romanato et al.
5,732,413 A 3/1998 Williams
5,885,622 A 3/1999 Daley
5,896,758 A 4/1999 Rock et al.
5,901,632 A 5/1999 Ryan
6,024,005 A 2/2000 Uozumi
6,029,376 A 2/2000 Cass
6,205,683 B1 3/2001 Clark et al.
6,308,536 B2 10/2001 Roell
6,345,598 B1 2/2002 Bogdanovich et al.
6,401,364 B1 6/2002 Burt
6,482,492 B1 11/2002 Hung
6,510,961 B1 1/2003 Head et al.
6,588,237 B2 7/2003 Cole et al.
6,679,152 B1 1/2004 Head et al.
6,696,001 B1 2/2004 Quddus
6,826,853 B1 12/2004 Zanatta
6,910,288 B2 6/2005 Dua
6,931,762 B1 8/2005 Dua
6,945,153 B2 * 9/2005 Knudsen ..... D04C 1/12 87/1
6,971,252 B2 12/2005 Therin et al.
7,004,967 B2 2/2006 Chouinard et al.
7,093,527 B2 8/2006 Rapaport et al.
7,168,951 B2 1/2007 Fischer et al.
7,204,903 B2 4/2007 Yasui
7,228,777 B2 * 6/2007 Morissette ..... D02G 3/38 87/5
7,252,028 B2 8/2007 Bechtold et al.
7,262,353 B2 8/2007 Bartholomew et al.
7,275,471 B2 10/2007 Nishri et al.
7,293,371 B2 11/2007 Aveni
7,300,014 B2 11/2007 Allen
7,347,011 B2 3/2008 Dua et al.
D578,294 S 10/2008 Mervar et al.
7,430,818 B2 10/2008 Valat et al.
7,444,916 B2 11/2008 Hirukawa
7,549,185 B2 6/2009 Yang
7,566,376 B2 7/2009 Matsuoka
7,703,218 B2 4/2010 Burgess
7,793,434 B2 9/2010 Sokolowski et al.
7,793,576 B2 9/2010 Head et al.
7,815,141 B2 10/2010 Uozumi et al.
7,836,608 B2 11/2010 Greene
7,870,681 B2 1/2011 Meschter
7,908,956 B2 3/2011 Dow et al.
7,913,426 B2 3/2011 Valat et al.
7,938,853 B2 5/2011 Chouinard et al.
7,941,942 B2 5/2011 Hooper et al.
7,963,747 B2 6/2011 Cairo
8,006,601 B2 8/2011 Inazawa et al.
8,051,585 B2 11/2011 Hope et al.
8,056,173 B2 11/2011 RongBo
8,061,253 B2 11/2011 Wybrow
8,210,086 B2 7/2012 Head et al.
8,261,648 B1 9/2012 Marchand et al.
8,266,827 B2 9/2012 Dojan et al.
8,312,645 B2 11/2012 Dojan et al.
8,312,646 B2 11/2012 Meschter et al.
8,388,791 B2 3/2013 Dojan et al.

(56) References Cited

U.S. PATENT DOCUMENTS 8,394,222 B2 3/2013 Rettig
8,438,757 B2 5/2013 Roser
8,511,214 B2 8/2013 Gries
8,544,197 B2 10/2013 Spanks et al.
8,544,199 B1 10/2013 Pentland
8,578,534 B2 11/2013 Langvin et al.
8,578,632 B2 11/2013 Bell et al.
8,651,007 B2 2/2014 Adams
8,690,962 B2 4/2014 Dignam et al.
8,757,038 B2 6/2014 Siegismund
8,770,081 B2 7/2014 David et al.
8,789,295 B2 7/2014 Burch et al.
8,789,452 B1 7/2014 Janardhan et al.
8,794,118 B2 8/2014 Dow et al.
8,819,963 B2 9/2014 Dojan et al.
8,959,959 B1 2/2015 Podhajny
8,984,776 B2 3/2015 Ludemann et al.
8,997,529 B1 4/2015 Podhajny
D737,561 S 9/2015 Aveni et al.
9,179,739 B2 11/2015 Bell et al.
D769,590 S 10/2016 Aveni et al.
9,681,708 B2 6/2017 Greene et al.
9,756,901 B2 9/2017 Musho et al.
D798,565 S 10/2017 Aveni et al.
2001/0007180 A1 7/2001 Bordin et al.
2003/0000111 A1 1/2003 Basso
2003/0213547 A1 11/2003 Ono et al.
2004/0118018 A1 6/2004 Dua
2005/0076536 A1 4/2005 Hatfield et al.
2005/0081402 A1 4/2005 Orei et al.
2005/0115284 A1 6/2005 Dua
2005/0178026 A1 8/2005 Friton
2005/0193592 A1 9/2005 Dua et al.
2005/0208860 A1 9/2005 Baron et al.
2005/0284002 A1 12/2005 Aveni
2006/0048413 A1 3/2006 Sokolowski et al.
2006/0059715 A1 3/2006 Aveni
2006/0260365 A1 11/2006 Miyamoto
2006/0265908 A1 11/2006 Palmer et al.
2006/0283042 A1 12/2006 Greene et al.
2006/0283048 A1 12/2006 Lebo
2007/0022627 A1 2/2007 Sokolowski et al.
2007/0062067 A1 3/2007 Covatch
2007/0180730 A1 8/2007 Greene et al.
2007/0245595 A1 10/2007 Chen et al.
2007/0271821 A1 11/2007 Meschter
2007/0271822 A1 11/2007 Meschter
2008/0005930 A1 1/2008 Skirrow
2008/0022553 A1 1/2008 McDonald et al.
2008/0078103 A1 4/2008 Liles
2008/0110048 A1 5/2008 Dua et al.
2008/0250668 A1 10/2008 Marvin et al.
2009/0126225 A1 5/2009 Jarvis
2009/0193961 A1 8/2009 Jensen et al.
2009/0241374 A1 10/2009 Sato et al.
2009/0306762 A1 12/2009 McCullagh et al.
2010/0018075 A1 1/2010 Meschter et al.
2010/0043253 A1 2/2010 Dojan et al.
2010/0095556 A1 4/2010 Jarvis
2010/0095557 A1 4/2010 Jarvis
2010/0107442 A1 5/2010 Hope et al.
2010/0139057 A1 6/2010 Soderberg et al.
2010/0154256 A1 6/2010 Dua
2010/0199520 A1 8/2010 Dua et al.
2010/0251491 A1 10/2010 Dojan et al.
2010/0251564 A1 10/2010 Meschter
2010/0319215 A1 12/2010 Roser
2011/0041359 A1 2/2011 Dojan et al.
2011/0067271 A1 3/2011 Foxen et al.
2011/0078921 A1 4/2011 Greene et al.
2011/0088285 A1 4/2011 Dojan et al.
2011/0094127 A1 4/2011 Dana, III
2011/0146104 A1 6/2011 Lafortune
2011/0239486 A1 10/2011 Berger et al.
2011/0266384 A1 11/2011 Goodman et al.
2012/0023786 A1 2/2012 Dojan
2012/0030965 A1 2/2012 Greene et al.
2012/0055044 A1 3/2012 Dojan et al.
2012/0066931 A1 3/2012 Dojan et al.
2012/0096742 A1 4/2012 Shim
2012/0117826 A1 5/2012 Jarvis
2012/0144698 A1 6/2012 McDowell
2012/0159813 A1 6/2012 Dua et al.
2012/0186102 A1 7/2012 Lee et al.
2012/0233882 A1 9/2012 Huffa et al.
2012/0234052 A1 9/2012 Huffa et al.
2012/0246973 A1 10/2012 Dua
2012/0255201 A1 10/2012 Little
2012/0279260 A1 11/2012 Dua et al.
2012/0291314 A1 11/2012 Sokolowski et al.
2012/0297643 A1 11/2012 Shaffer et al.
2013/0019500 A1 1/2013 Greene
2013/0025157 A1 1/2013 Wan et al.
2013/0055590 A1 3/2013 Mokos
2013/0081307 A1 4/2013 del Biondi et al.
2013/0211492 A1* 8/2013 Schneider ..... A61F 2/90 623/1.11
2013/0219636 A1 8/2013 Dojan et al.
2013/0255103 A1 10/2013 Dua et al.
2013/0260104 A1 10/2013 Dua et al.
2013/0260629 A1 10/2013 Dua et al.
2013/0269159 A1 10/2013 Robitaille et al.
2013/0269209 A1 10/2013 Lang et al.
2013/0269212 A1 10/2013 Little
2013/0291293 A1 11/2013 Jessiman et al.
2013/0304232 A1 11/2013 Gries
2013/0305465 A1 11/2013 Siegismund
2013/0305911 A1 11/2013 Masson et al.
2013/0312284 A1 11/2013 Berend et al.
2014/0000043 A1 1/2014 Boardman et al.
2014/0007458 A1 1/2014 Berger et al.
2014/0068838 A1 3/2014 Beers et al.
2014/0070042 A1 3/2014 Beers et al.
2014/0082905 A1 3/2014 Wen
2014/0088688 A1 3/2014 Lilburn et al.
2014/0109441 A1 4/2014 McDowell et al.
2014/0130372 A1 5/2014 Aveni et al.
2014/0134405 A1 5/2014 Yang
2014/0137433 A1 5/2014 Craig
2014/0137434 A1 5/2014 Craig
2014/0150292 A1 6/2014 Podhajny et al.
2014/0173932 A1 6/2014 Bell
2014/0173934 A1 6/2014 Bell
2014/0173935 A1 6/2014 Sabbioni
2014/0182447 A1 7/2014 Kang et al.
2014/0189964 A1 7/2014 Wen et al.
2014/0196316 A1 7/2014 Follet
2014/0215850 A1 8/2014 Redl et al.
2014/0237854 A1 8/2014 Fallon
2014/0245633 A1 9/2014 Podhajny et al.
2014/0259760 A1 9/2014 Dojan et al.
2014/0310983 A1 10/2014 Tamm et al.
2014/0310984 A1 10/2014 Tamm et al.
2014/0310987 A1 10/2014 Sokolowski et al.
2014/0338222 A1 11/2014 Song
2014/0352173 A1 12/2014 Bell et al.
2014/0373389 A1 12/2014 Bruce
2014/0377488 A1 12/2014 Jamison
2015/0007451 A1 1/2015 Bruce
2015/0013187 A1 1/2015 Taniguchi et al.
2015/0052778 A1 2/2015 Kirk et al.
2015/0075031 A1 3/2015 Podhajny et al.
2015/0143716 A1 5/2015 Long et al.
2015/0143720 A1 5/2015 Avar
2015/0201705 A1 7/2015 Doremus et al.
2015/0201707 A1 7/2015 Bruce
2015/0202915 A1 7/2015 Lee
2015/0272274 A1 10/2015 Berns et al.
2015/0282565 A1 10/2015 Kilgore
2015/0305442 A1 10/2015 Ravindran
2015/0313316 A1 11/2015 Boucher et al.
2015/0320139 A1 11/2015 Peitzker et al.
2015/0342286 A1 12/2015 Huffman et al.
2015/0374064 A1 12/2015 Pierobon

(56) References Cited

U.S. PATENT DOCUMENTS

| | | | | |
|---|---|---|---|---|
| 2016/0021979 | A1 | 1/2016 | Iuchi et al. | |
| 2016/0029736 | A1 | 2/2016 | Meir | |
| 2016/0058100 | A1 | 3/2016 | Dealey et al. | |
| 2016/0076178 | A1* | 3/2016 | Head | D04C 3/48 87/32 |
| 2016/0095377 | A1 | 4/2016 | Tamm | |
| 2016/0106182 | A1 | 4/2016 | Yun | |
| 2016/0166000 | A1 | 6/2016 | Bruce et al. | |
| 2016/0166007 | A1 | 6/2016 | Bruce et al. | |
| 2016/0166010 | A1 | 6/2016 | Bruce et al. | |
| 2016/0168774 | A1 | 6/2016 | Breithaupt et al. | |
| 2016/0174660 | A1 | 6/2016 | Iuchi et al. | |
| 2016/0185062 | A1 | 6/2016 | Boucher et al. | |
| 2016/0208421 | A1 | 7/2016 | Baines et al. | |
| 2016/0213095 | A1 | 7/2016 | Kohatsu et al. | |
| 2016/0345675 | A1 | 12/2016 | Bruce et al. | |
| 2017/0035149 | A1 | 2/2017 | Bruce et al. | |
| 2017/0325545 | A1 | 11/2017 | Becker et al. | |
| 2017/0325546 | A1 | 11/2017 | Becker et al. | |
| 2019/0150552 | A1 | 5/2019 | Casillas et al. | |

FOREIGN PATENT DOCUMENTS

| | | | |
|---|---|---|---|
| CN | 1121403 | A | 5/1996 |
| CN | 1883325 | A | 12/2006 |
| CN | 2930360 | Y | 8/2007 |
| CN | 201175007 | Y | 1/2009 |
| CN | 201356120 | Y | 12/2009 |
| CN | 102271548 | A | 12/2011 |
| CN | 102987631 | A | 3/2013 |
| CN | 203369442 | U | 1/2014 |
| CN | 20403521 | U | 12/2014 |
| DE | 726634 | C | 10/1942 |
| DE | 1140107 | B | 11/1962 |
| DE | 4306286 | A1 | 9/1993 |
| DE | 102011011185 | A1 | 8/2012 |
| DE | 102011119245 | A1 | 10/2012 |
| EP | 0372370 | A2 | 6/1990 |
| EP | 1486601 | A1 | 12/2004 |
| EP | 2657384 | A1 | 10/2013 |
| EP | 2792261 | A1 | 10/2014 |
| EP | 2792264 | A2 | 10/2014 |
| EP | 2811056 | A1 | 12/2014 |
| EP | 3011855 | A1 | 4/2016 |
| FR | 1012719 | A | 7/1952 |
| GB | 430805 | A | 6/1935 |
| GB | 477556 | A | 1/1938 |
| GB | 1083849 | A | 9/1967 |
| JP | S51107964 | | 9/1976 |
| JP | H07054250 | A | 2/1995 |
| JP | H0733076 | B2 | 4/1995 |
| JP | H07216703 | A | 8/1995 |
| JP | 08109553 | | 4/1996 |
| JP | H09322810 | A | 12/1997 |
| JP | H10158965 | A | 6/1998 |
| JP | 2001030361 | A | 2/2001 |
| JP | 2004105323 | A | 4/2004 |
| JP | 2004339651 | A | 12/2004 |
| JP | 20050422266 | A | 2/2005 |
| JP | 2005102933 | A | 4/2005 |
| JP | 2005290628 | A | 10/2005 |
| JP | 2006009175 | A | 1/2006 |
| JP | 2006161167 | A | 6/2006 |
| JP | 2008240187 | A | 10/2008 |
| KR | 20020038168 | A | 5/2002 |
| KR | 100737426 | B1 | 3/2007 |
| WO | 0007475 | A1 | 2/2000 |
| WO | 0036943 | A1 | 6/2000 |
| WO | 03016036 | A2 | 2/2003 |
| WO | 2009000371 | A1 | 12/2008 |
| WO | 2010080182 | A1 | 7/2010 |
| WO | 2011082391 | A1 | 7/2011 |
| WO | 2011111564 | A1 | 9/2011 |
| WO | 2011126837 | A2 | 10/2011 |
| WO | 2011137405 | A1 | 11/2011 |
| WO | 2013071679 | A1 | 5/2013 |
| WO | 2013126313 | A2 | 8/2013 |
| WO | 2014134244 | A1 | 9/2014 |
| WO | 2014209594 | A1 | 12/2014 |
| WO | 2014209596 | A1 | 12/2014 |
| WO | 2016191478 | A1 | 12/2016 |

OTHER PUBLICATIONS

International Search Report and Written Opinion dated Sep. 19, 2014 in PCT/US2014/041659 10 pages.

International Search Report and Written Opinion dated Sep. 23, 2014 in International Patent Application No. PCT/US2014/041669. 10 pages.

Australian Office Action dated May 28, 2016 for Australian Patent Application No. 2014303040, 3 Pages.

Australian Office Action dated May 28, 2016 for Australian Patent Application No. 2014303042, 2 Pages.

Non-Final Office Action dated Jun. 1, 2016 for U.S. Appl. No. 14/565,568, 5 pages.

Non-Final Office Action dated Jun. 22, 2016 in U.S. Appl. No. 14/495,252, 13 pages.

Non-Final Office Action dated Jul. 1, 2016 in U.S. Appl. No. 14/565,598, 10 pages.

Non-Final Office Action dated Aug. 19, 2016 for U.S. Appl. No. 14/163,438, 15 pages.

International Search Report and Written Opinion dated Aug. 19, 2016 for International Patent Application No. PCT/US2016/034107, 17 pages.

Canadian Examiner's Report dated Sep. 19, 2016 in Canadian Patent Application No. 2,910,349, 3 pages.

Final Office Action dated Dec. 9, 2016 in U.S. Appl. No. 14/565,598, 17 pages.

International Search Report and Written Opinion dated Jan. 12, 2017 in International Patent Application No. PCT/2016/045313, 15 pages.

Non-Final Office Action dated Jan. 17, 2017 in U.S. Appl. No. 14/721,507, 12 pages.

Final Office Action dated Feb. 16, 2017 in U.S. Appl. No. 14/163,438, 17 pages.

Final Office Action dated Feb. 23, 2017 in U.S. Appl. No. 14/495,252, 15 pages.

Non-Final Office Action dated Jun. 22, 2017 in U.S. Appl. No. 14/495,252, 13 pages.

European Search Report dated Mar. 14, 2017 for European Patent Application No. 16001887.5, 9 pages.

Canadian Examiner's Report dated Jun. 13, 2017 in Canadian Patent Application No. 2,910,350, 3 pages.

International Search Report and Written Opinion dated Apr. 4, 2016 for International Patent Application No. PCT/US2015055902, 17 pages.

International Search Report and Written Opinion dated Jun. 16, 2016 in International Patent Application No. PCT/US2015/055868, 11 pages.

International Preliminary Report on Patentability dated Jun. 22, 2017 in International Patent Application No. PCT/US2015/056533, 6 pages.

International Preliminary Report on Patentability dated Jun. 22, 2017 in International Patent Application No. PCT/US2015/055868, 10 pages.

International Preliminary Report on Patentability dated Jun. 22, 2017 in International Patent Application No. PCT/US2015/055902, 10 pages.

Canadian Examiner's Report dated Jun. 28, 2017 in Canadian Patent Application No. 2,910,349, 3 pages.

Non-Final Office Action dated Aug. 23, 2017 in U.S. Appl. No. 14/565,598, 15 pages.

Non-Final Office Action dated Sep. 14, 2017 in U.S. Appl. No. 14/820,822, 14 pages.

Final Office Action dated Aug. 14, 2017 in U.S. Appl. No. 14/721,507, 12 pages.

(56) References Cited

OTHER PUBLICATIONS

Non-Final Office Action dated Oct. 19, 2017 in U.S. Appl. No. 14/163,438, 18 pages.
Non-Final Office Action dated Oct. 27, 2017 in U.S. Appl. No. 14/566,215, 21 pages.
U.S. Appl. No. 14/565,682, filed Dec. 10, 2014.
Branscomb et al., "New Directions in Braiding", Journal of Engineered Fibers and Fabrics, vol. 8, Issue 2—2013—http://www.jeffournal.org, pp. 11-24.
Final Office Action dated Nov. 1, 2017 in U.S. Appl. No. 14/495,252, 14 pages.
Office Action dated Nov. 24, 2017 in Australian Patent Application No. 2015361198, 3 pages.
International Preliminary Report on Patentability dated Dec. 7, 2017 in International Patent Application No. PCT/US2016/034109, 11 pages.
International Preliminary Report on Patentability dated Dec. 7, 2017 in International Patent Application No. PCT/US2016/034107, 8 pages.
Office Action dated Feb. 12, 2018 in Australian Patent Application No. 2015361198, 3 pages.
Non-Final Office Action dated Mar. 29, 2018 in U.S. Appl. No. 14/495,252, 14 pages.
Braiding Definition for the clothing industry, Apparel Search Company, 5 pages. Accessed Jan. 24, 2017, Available at: http://www.apparelsearch.com/definitions/miscellaneous/braiding.htm.
Non-Final Office Action dated May 10, 2018 in U.S. Appl. No. 14/565,598, 17 pages.
Final Office Action dated Jun. 4, 2018 in U.S. Appl. No. 14/820,822, 14 pages.
Final Office Action dated Jun. 26, 2018 in U.S. Appl. No. 14/566,215, 17 pages.
Final Office Action dated Jul. 13, 2018 in U.S. Appl. No. 14/163,438, 15 pages.
International Search Report and Written Opinion dated Sep. 10, 2018 in International Patent Application No. PCT/US2018/035404, 13 pages.
Final Office Action dated Sep. 11, 2018 in U.S. Appl. No. 14/495,252, 14 pages.
Non-Final Office Action dated Oct. 1, 2018 in U.S. Appl. No. 14/820,822, 15 pages.
Non-Final Office Action dated Sep. 18, 2018 in U.S. Appl. No. 15/613,983, 7 pages.
Final Office Action dated Dec. 14, 2018 in U.S. Appl. No. 14/565,598, 22 pages.
Notice of Allowance dated Jan. 11, 2019 in U.S. Appl. No. 15/613,983, 7 pages.
Decision to grant a European patent pursuant to Article 97(1) dated Nov. 8, 2018 in European Patent Application No. 14737100.9, 1 page.
Communication pursuant to Article 94(3) dated Nov. 22, 2018 in European Patent Application No. 16731401.2, 5 pages.
Communication pursuant to Article 94(3) dated Nov. 23, 2018 in European Patent Application No. 15787425.6, 7 pages.
Communication under Rule 71(3) dated Feb. 20, 2019 in European Patent Application No. 15785032.2, 5 pages.
Communication under Rule 71(3) dated Mar. 13, 2019 in European Patent Application No. 15787396.9, 5 pages.
Final Office Action dated Apr. 25, 2019 in U.S. Appl. No. 14/820,822, 15 pages.
Partial search report dated Apr. 26, 2019 in European Patent Application No. 18202740.9, 13 pages.
Communication pursuant to Article 94(3) dated May 13, 2019 in European Patent Application No. 16001887.5, 4 pages.
Communication under Rule 71(3) dated May 16, 2019 in European Patent Application No. 16731401.2, 5 pages.
Communication under Rule 71(3) dated Jun. 21, 2019 in European Patent Application No. 15785032.2, 2 pages.
Extended Search Report dated Aug. 16, 2019 in European Patent Application No. 18202740.9, 11 pages.
Non-Final Office Action dated Aug. 19, 2019 in U.S. Appl. No. 14/163,438, 15 pages.
Non-Final Office Action dated Aug. 21, 2009 in U.S. Appl. No. 14/566,215, 21 pages.

* cited by examiner

BRAIDED UPPER WITH MULTIPLE MATERIALS

BACKGROUND

The present embodiments relate generally to articles of footwear, and in particular to articles of footwear with uppers.

Articles of footwear generally include an upper and one or more sole structures. The upper may be formed from a variety of materials that are stitched or adhesively bonded together to form a void within the footwear for comfortably and securely receiving a foot. The sole structures may include midsole structures that provide cushioning and shock absorption.

SUMMARY

In one aspect, an article of footwear having a braided upper comprises of a first braided strand and a second braided strand. The first braided strand comprises of a first group of tensile elements. The second braided strand comprises of a second group of tensile elements. The first braided strand is different than the second braided strand. The first braided strand is braided with the second braided strand to form the braided upper.

In another aspect, an article of footwear having a braided upper comprises of a first braided strand and a second braided strand. The first braided strand comprises of a first group of tensile elements. The second braided strand comprises of a second group of tensile elements. The first group of tensile elements have a first cross-sectional area. The second group of tensile elements have a second cross-sectional area. The first cross-sectional area is different than the second cross-sectional area. The first braided strand is braided with the second braided strand to form the braided upper.

In another aspect, an article of footwear having a braided upper comprises of a first braided strand and a second braided strand. The first braided strand comprises of a first group of tensile elements. The second braided strand comprises of a second group of tensile elements. The first group of tensile elements are made of a first material. The second group of tensile elements are made from a second material. The first material is different than the second material. The first braided strand is braided with the second braided strand to form the braided upper.

In another aspect, a method of making an article of footwear comprises of braiding a first group of tensile elements into a first braided strand. Braiding a second group of tensile elements into a second braided strand. Inserting a last through a central braiding area of an over-braiding device, wherein the over-braiding device is configured with the first braided strand and the second braided strand. Over-braiding over the last to form a braided upper with the first braided strand and the second braided strand. Removing the last from the braided upper.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
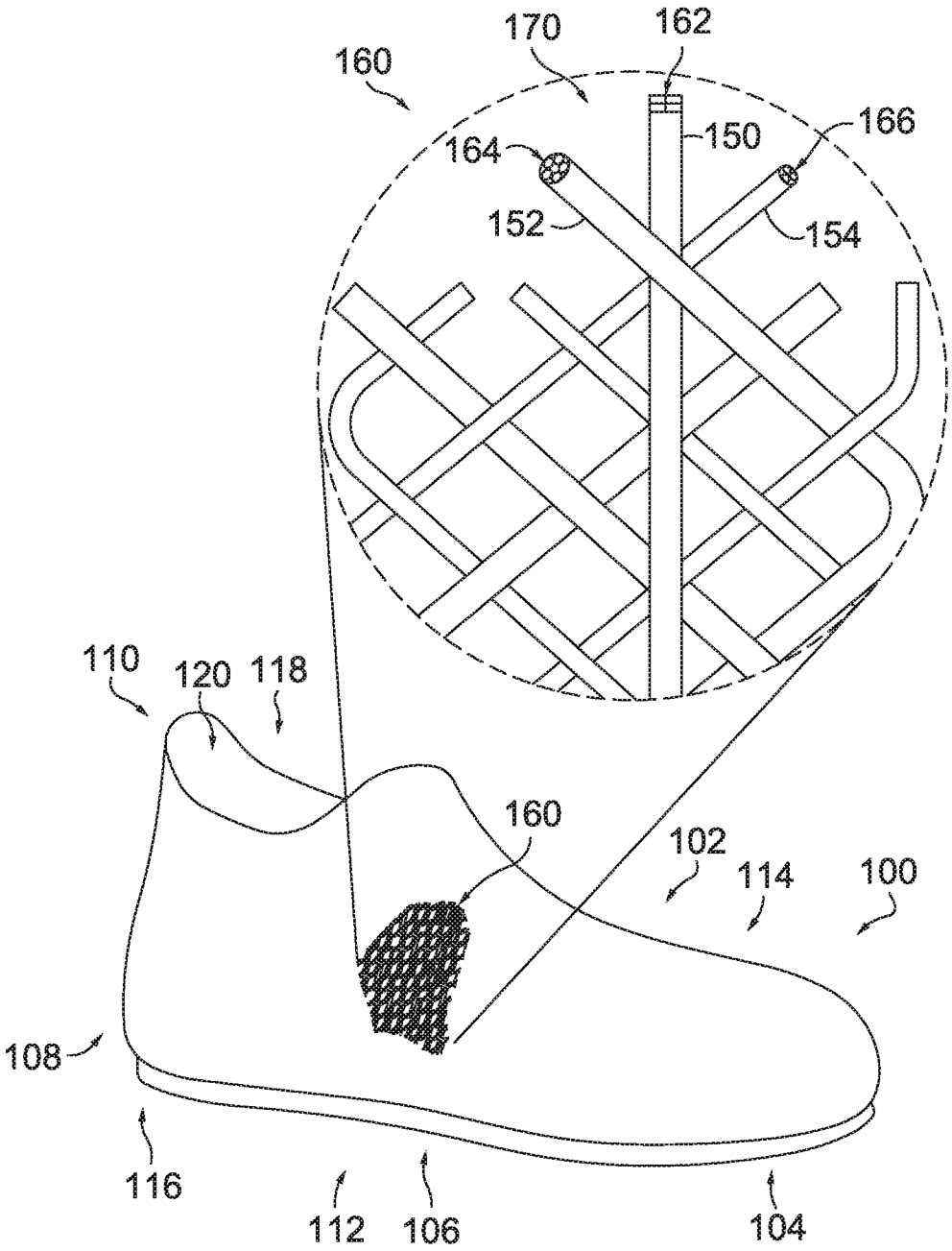
FIG. 1 is a schematic isometric view of an embodiment of an embodiment of an article of footwear having a braided upper with an enlarged view of a braided structure.

FIG. 1 illustrates a schematic isometric view of an embodiment of an embodiment of an article of footwear having a braided upper with an enlarged view of a braided structure. In some embodiments, article of footwear 100, also referred to simply as article 100, is in the form of an athletic shoe. In some other embodiments, the provisions discussed herein for article 100 could be incorporated into various other kinds of footwear including, but not limited to: basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for article of footwear 100 could be incorporated into various other kinds of non-sports related footwear, including, but not limited to: slippers, sandals, high-heeled footwear, loafers, as well as other kinds of footwear.

In some embodiments, article 100 may be characterized by various directional adjectives and reference portions. These directions and reference portions may facilitate in describing the portions of an article of footwear. Moreover, these directions and reference portions may also be used in describing sub-components of an article of footwear (e.g., directions and/or portions of a midsole structure, an outer sole structure, an upper or any other components).

For consistency and convenience, directional adjective are employed throughout this detailed description corresponding to the illustrated embodiments. The term "longitudinal" as used throughout this detailed description and in the claims may refer to a direction extending a length article 100. In some cases, the longitudinal direction may extend from a forefoot region to a heel region of the article 100. Also, the term "lateral" as used throughout this detailed description and in the claims may refer to a direction extending along a width of the article 100. In other words, the lateral direction may extend between a lateral side and a medial side of the article 100. Furthermore, the term "vertical" as used throughout this detailed description and in the claims may refer to a direction generally perpendicular to a lateral and longitudinal direction. For example, in some cases where article 100 is planted flat on a ground surface, the vertical direction may extend from the ground surface upward. In addition, the term "proximal" may refer to a portion of an article 100 that is closer to portions of a foot, for example, when the article 100 is worn. Similarly, the term "distal" may refer to a portion of an article 100 that is further from a portion of a foot when the article 100 is worn. It will be understood that each of these directional adjectives may be used in describing individual components of article 100, such as an upper, an outsole member, a midsole member, as well as other components of an article of footwear.

For purpose of reference, article 100 may be divided into forefoot portion 104, midfoot portion 106, and heel portion 108. As shown in FIG. 1, article 100 may be associated with the right foot; however, it should be understood that the following discussion may equally apply to a mirror image of article 100 that is intended for use with a left foot. Forefoot portion 104 may be generally associated with the toes and joints connecting the metatarsals with the phalanges. Midfoot portion 106 may be generally associated with the arch of a foot. Likewise, heel portion 108 may be generally associated with the heel of a foot, including the calcaneus bone. Article 100 may also include an ankle portion 110 (which may also be referred to as a cuff portion). In addition, article 100 may include lateral side 112 and medial side 114. In particular, lateral side 112 and medial side 114 may be opposing sides of article 100. In general, lateral side 112 may be associated with the outside parts of a foot while medial side 114 may be associated with the inside part of a foot. Furthermore, lateral side 112 and medial side 114 may extend through forefoot portion 104, midfoot portion 106, and heel portion 108.

It will be understood that forefoot portion 104, midfoot portion 106, and heel portion 108 are only intended for purposes of description and are not intended to demarcate precise regions of article 100. Likewise, lateral side 112 and medial side 114 are intended to represent generally two sides rather than precisely demarcating article 100 into two halves.

In some embodiments, article 100 may be configured with an upper 102 and sole structure 116. Upper 102 may include an opening 118 to provide access to an interior cavity 120. In some embodiments, upper 102 may incorporate a plurality of material elements (e.g. textiles, polymer sheets, foam layers, leather, synthetic leather) that are stitched or bonded together to form an interior void for securely and comfortable receiving a foot. In some cases, the material elements may be selected to impart properties of durability, air-permeability, wear resistance, flexibility, and comfort, for example, to specific areas of upper 102.

In some embodiments, the upper 102 may be a braided upper. The following description makes use of the terms tensile elements, braided strands and braided structures and variants thereof. As used herein, the term "tensile element" refers to any kinds of threads, yarns, strings, filaments, fibers, wires, cables as well as possibly other kinds of tensile elements described below or known in the art. As used herein, tensile elements may describe generally elongated materials with lengths much greater than corresponding diameters. In some embodiments, tensile elements may be approximately one-dimensional elements. In some other embodiments, tensile elements may be approximately two-dimensional (e.g., with thicknesses much less than their lengths and widths). Tensile elements may be joined to form braided strands. As used herein, the term "braided strand" and its variants thereof refers to any strand formed from intertwining three or more tensile elements together. A braided strand could take the form of a braided cord, a braided rope or any other elongated braided structure. As with tensile elements, the length of a braided strand may be significantly greater than the width and/or thickness (or diameter) of the braided strand. Finally, as discussed in further detail below, braided strands may further be combined to form braided structures. As used herein, the term "braided structure" may refer to any structure formed from intertwining three or more braided strands together. Braided structures could take the form of braided cords, ropes or strands. Alternatively, braided structures may be configured as two dimensional structures (e.g., flat braids) or three-dimensional structures (e.g., braided tubes) such as with lengths and width (or diameter) significantly greater than their thicknesses.

Braiding can be used to form three-dimensional structures by braiding tensile elements over a form or a last, also referred to as over-braiding. Braided structures may be fabricated manually, or may be manufactured using automated braiding machinery, such as the machinery disclosed in U.S. Pat. Nos. 7,252,028; 8,261,648; 5,361,674; 5,398,586; and 4,275,638, all of which are incorporated by reference in their entirety herein.

The braided upper may be attached to a sole structure using adhesives, welding, molding, fusing stitching, stapling or other appropriate methods. The sole can include an insole made of a relatively soft material to provide cushioning. The outsole is generally made of a harder, more abrasion-resistant material such as rubber or EVA. The outsole may have ground-engaging structures such as cleats or spikes on its bottom surface, for providing increased traction.

Referring to the enlarged view in FIG. 1, in some embodiments, a plurality or group of different tensile elements or a plurality of different braided strands may be braided to form a larger braided structure. For purposes of clarity, in some embodiments, a biaxial braid comprises of singular tensile elements arranged in two directions. In some embodiments, the first direction is at a relative to the second direction. In some embodiments, this angle is also called the "braid angle" or the "fiber angle" or the "bias angle" and may range from about 15 degrees to about 75 degrees. In some other embodiments, a triaxial braid modifies the biaxial braid with the addition of a third tensile element. The third tensile element may be referred to as the axial or warp tensile element. In some embodiments, the axial tensile element may be used to stabilize, increase strength, or reduce elongation of the braided structure. In an exemplary embodiment, first braided strand 150, second braided strand 152, and third braided strand 154, produced from braided tensile elements, are subsequently braided together to produce triaxial braided structure 160. In this exemplary arrangement, first braided strand 150 may be viewed as the axial component of triaxial braided structure 160.

In some embodiments, the braided strands are comprised of individual tensile elements 170. In some embodiments tensile elements 170 may be uniform in terms of shape, size, or some other physical property. In some other embodiments, tensile elements 170 may be different when used to form the braided strand. In one embodiment, first tensile elements 162 have been braided to form first braided strand 150. Further, second tensile elements 164 have been braided to form second braided strand 152. Further still, third tensile elements 166 have been braided to form third braided strand 154.

Some embodiments may include provisions allowing each braided strand to impart different physical properties to various parts of braided structure 160. In some embodiments, tensile elements 170 may impart different properties relating to the shapes, sizes or cross-sections for the braided strands. For example, in one embodiment, first tensile elements 162 may be made from leather and therefore have a substantially square shape and cross-sectional shape. Thus, first braided strand 150 may have a substantially square cross-sectional shape when braided. Further, second tensile elements 164, may be fabricated from a different material, than either first tensile elements 162 or third tensile elements 166. The use of a different material may impart unique physical properties to second braided strand 152 and braided structure 160 overall. Further still, third tensile elements 166, each having a substantially circular cross-sectional shape, may in turn form a substantially circular cross-sectional shape for third braided strand 154. It is understood that an individual tensile element from first tensile elements 162, may be braided with an individual tensile element from second tensile elements 164 made from a different material, and further braided with an individual tensile element from third tensile elements 166, with a substantially circular cross-sectional shape to form braided strands. These braided strands may then be used to produce the larger braided structure 160. It is also to be understood that in some embodiments, interbraiding these thicker braided strands to form a braided structure or an upper will be thicker than a braided structure or upper that has is formed from braiding individual tensile elements.

In some embodiments, various properties of tensile elements 170, used to form each braided strand, may be chosen in order to vary the overall braided structure 160. In some embodiments, different tensile elements 170 with different properties—material, shape, size—can be combined to form a braided strand which in turn is used to produce a braided structure. The combining of different tensile elements 170 to produce a variety of braided strands and braided structures will be explained further in detail below.

Figure 2:
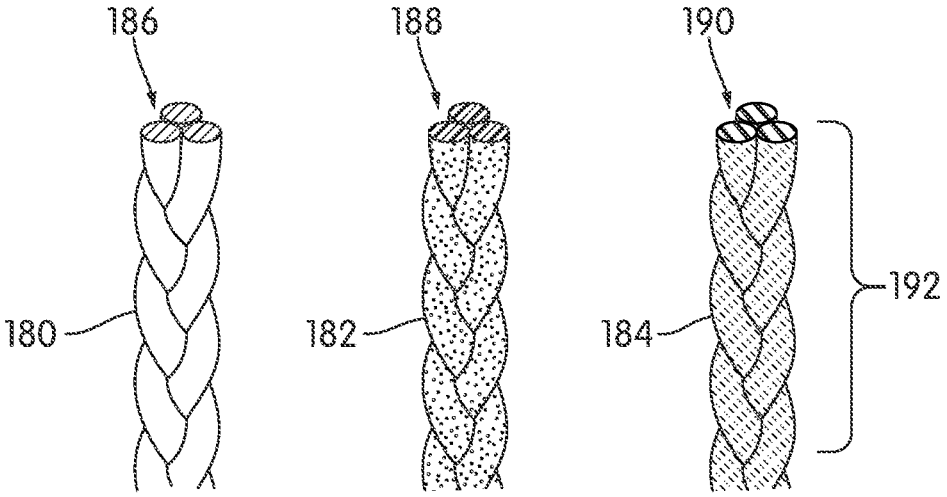
FIG. 2 is schematic view of an embodiment of different braided strands made from different materials in a first configuration.
Figure 3:
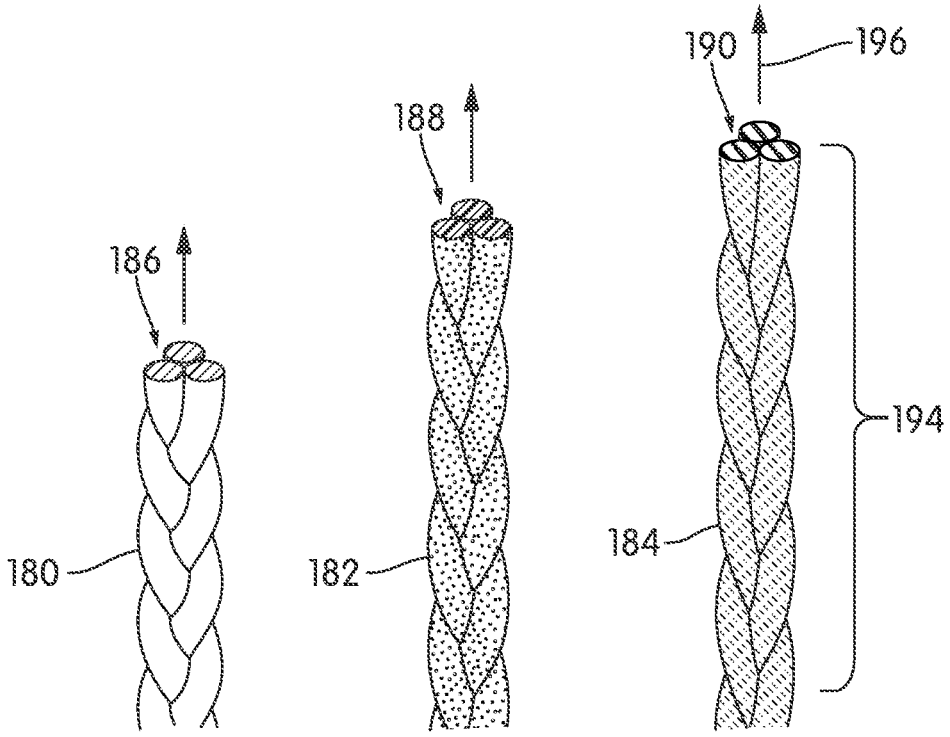
FIG. 3 is schematic view of an embodiment of different braided strands made from different materials in a second configuration.

FIGS. 2-3 illustrate an embodiment of three braided strands, each having different physical properties. In some embodiments, the physical properties may relate to material properties discussed above. In some embodiments, the tensile elements used to form braided strands which are used to produce a larger braided structure, can be fabricated from fibers such as nylon, carbon, polyurethane, polyester, cotton, aramid (e.g., Kevlar®), polyethylene or polypropylene. These braided strands can be braided to form three-dimensional braided structures for a wide variety of applications.

In some embodiments, the use of tensile elements made from different materials may provide a braided upper with specific features that can be tailored to a particular athletic or recreational activity. In some embodiments, braided strands made of a material with a greater tensile strength may be used in those sections of the footwear that undergo higher stress during a specific activity. Softer and more pliable braided strands may be used in sections of the footwear that are not subject to high stress, to provide a more comfortable and closely-fitting upper in those sections. Braided strands of an abrasion-resistant material may be used in particular regions of the footwear that may experience frequent contact against abrasive surfaces such as concrete or sand. Braided strands of a more durable material may be used in those regions of an upper that experience frequent contact with other surfaces, such as the surface of a football or soccer ball.

As shown in FIG. 2, in some embodiments, first braided strand 180, second braided strand 182, and third braided strand 184 may each have different physical properties based on their tensile elements. In one embodiment, first braided strand 180, comprised of first tensile elements 186, is more rigid than second braided strand 182. Second braided strand 182, comprised of second tensile elements 188, may have greater elasticity than first braided strand 180. Further, third braided strand 184, comprised of third tensile elements 190, may have greater elasticity than either first braided strand 180 and second braided strand 182. In FIG. 2, all three braided strands are viewed in a first position 192.

In FIG. 3, the elastic properties of the three braided strands are shown in a stretched or second position 194 as all three undergo tension along a first direction 196. In some embodiments, third braided strand 184 has a greater elasticity than second braided strand 182 or first braided strand 180. Therefore, third braided strand 184 stretches the farthest from its first position 192. Further, second braided strand 182 has greater elasticity than first braided strand 180. Therefore, second braided strand 182 stretches farther than first braided strand 180 but less than third braided strand 184. First braided strand 180 has less elasticity than either third braided strand 184 and second braided strand 182. Therefore, first braided strand 180 stretches less than either third braided strand 184 and second braided strand 182.

It is to be noted that in other embodiments, the physical property of the tensile elements may be related to their tensile strength. Therefore, first tensile elements 186 may have a first tensile strength. Second tensile elements 188 may have a second tensile strength different from first tensile strength. Further, third tensile elements 190 may have a third tensile strength different from either first or second tensile strength.

Figure 4:
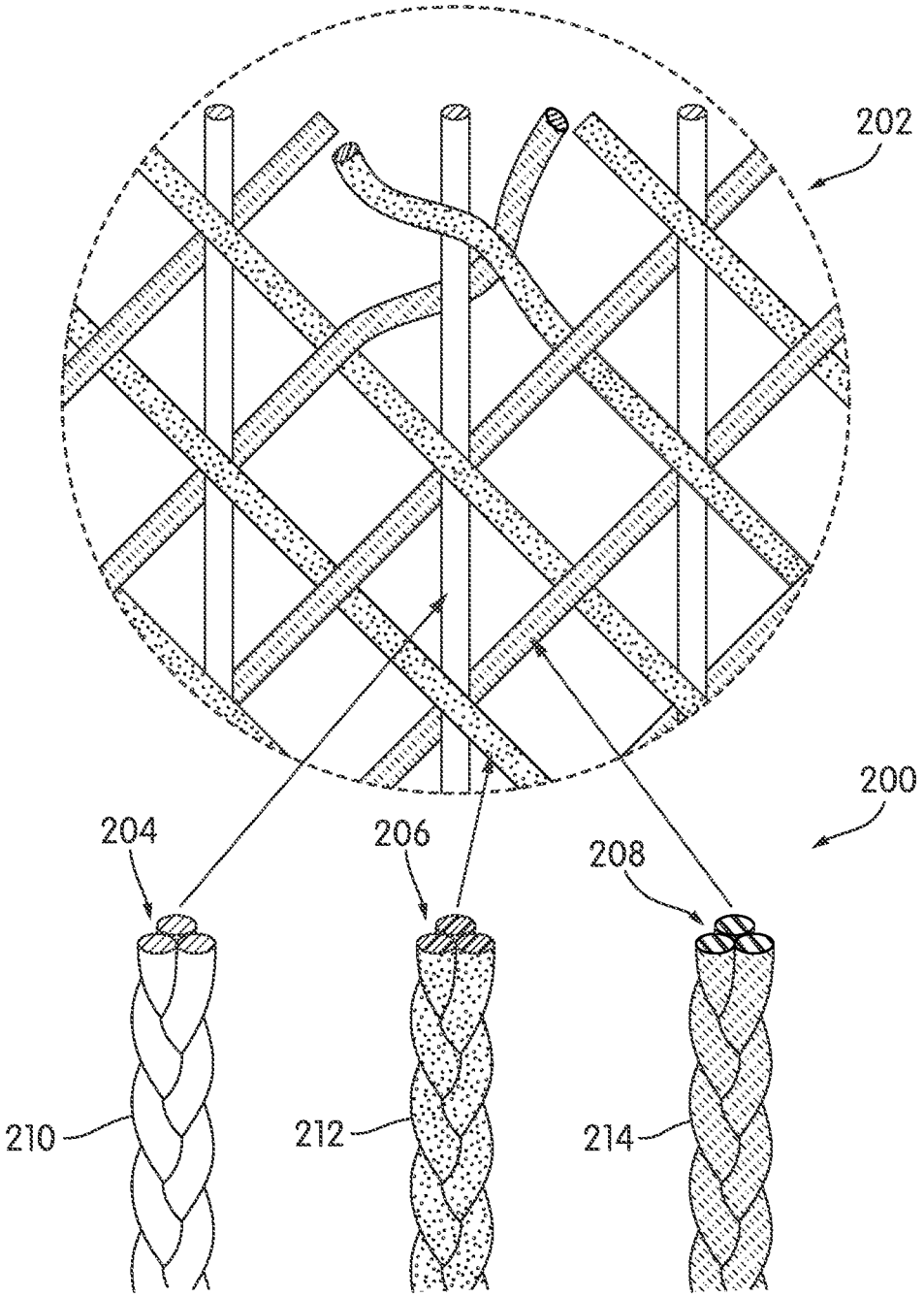
FIG. 4 is schematic view of an embodiment of different braided strands made from different materials with an enlarged view of a braided structure.

Referring to FIG. 4, another embodiment of different braided strands made from tensile elements 200 of different materials is illustrated. The braided strands are braided to produce a braided structure 202, a portion of which is illustrated in the enlarged view. As with the embodiments shown in FIGS. 2 and 3, these embodiments in FIG. 4 are comprised of different materials and may have different material properties including but not limited to rigidity, tensile strength, compressive strength, shear strength, elasticity, etc.

In one embodiment, braided structure 202 may comprise of first braided strand 210, second braided strand 212, and third braided strand 214. First braided strand 210 may be fabricated from first tensile elements 204 made from a first material. Second braided strand 212 may be fabricated from second tensile elements 206 made from a second material.

Third braided strand 214 may be fabricated from third tensile elements 208 made from a third material. For this exemplary embodiment, braided strand 214, considered the most elastic, will provide increased stretching capabilities along an axis parallel with the braided strand. In some other embodiments, braided structure may include more braided strands made from additional tensile elements composed from a different material than first, second, or third material. In still other embodiments, braided strand 214 can be produced by interbraiding a single first tensile element 204 with a single second tensile element 206 and a single third tensile element 208. This braided strand can then be used in forming braided structure 202.

Some embodiments may provide a braided structure with other physical properties because of the different tensile elements used to form different braided strands. In some embodiments, the tensile elements may have different physical properties relating to their geometry or the shape of their cross-sectional area. In some embodiments, tensile elements may have a cross-sectional shape that is square. In some other embodiments, tensile elements may have cross-sectional shapes that are round or circular. The use of tensile elements or braided strands with different cross-sectional shapes to form a braided structure may impart unique physical properties on an upper.

In some embodiments, the use of tensile elements having different cross-sectioned shapes to form different braided strands may provide a braided upper with distinct features. In some embodiments, the different cross-section shapes may offer advantages in terms of liquid absorption, elasticity, heat shielding, insulation and reduction of material or volume. For example, in some embodiments, intertwining tensile elements with a square cross-sectioned shape with tensile elements having circular or round cross-sectioned shapes may provide voids between the tensile elements which in turn may result in a braided structure with improved liquid absorption, and rapid drying, without any degradation of tensile strength.

Figure 5:
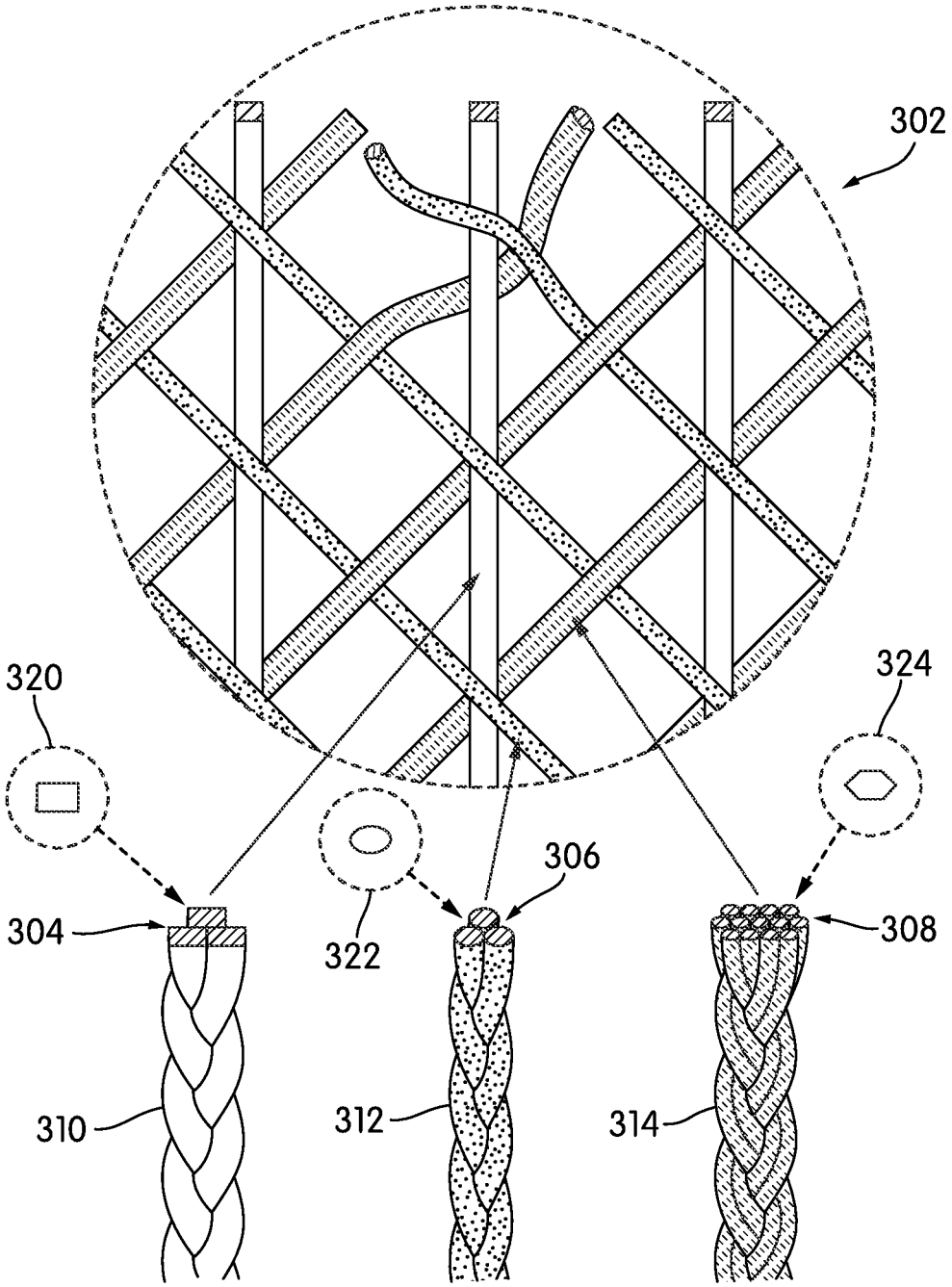
FIG. 5 is schematic view of an embodiment of different braided strands with different overall cross-sectional shapes with an enlarged view of a braided structure.

FIG. 5 illustrates different braided strands, made from tensile elements (not shown), each braided strand having different cross-sectional shapes due to the different cross-sectional shape of tensile elements. The braided strands may be braided to produce a larger braided structure 302, a portion of which is shown in the enlarged view.

In one embodiment, braided structure 302 may comprise of first braided strand 310, second braided strand 312, and third braided strand 314. First braided strand 310 may be constructed from first tensile elements 304 with substantially square cross-sectional shape. Thus, first braided strand 310 will have an overall first cross-sectional shape 320 that is predominantly square shaped. Second braided strand 312 may be constructed from second tensile elements 306 with circular cross-sectional shapes. Thus, second braided strand 312 may have an overall second cross-sectional shape 322 that is more circular. Third braided strand 314 may be constructed from third tensile elements 308 which also have circular cross-sectional shapes but with a different cross-sectional diameter size. Further, the quantity of third tensile elements 308 to form third braided strand 314 may be greater, due to their diameter sizes, than the quantity of tensile elements used to form first braided strand 310 or second braided strand 312. Thus, third braided strand 314 may have an overall third cross-sectional shape 324 that is hexagonal.

In some other embodiments, other braided strands may be constructed into other shapes having different cross-sections. In still some other embodiments, a plurality of braided strands can be produced by interbraiding first tensile element 304 with second tensile element 306 and third tensile element 308 to form a braided strand. These braided strands can then be braided to form braided structure 302.

Figure 6:
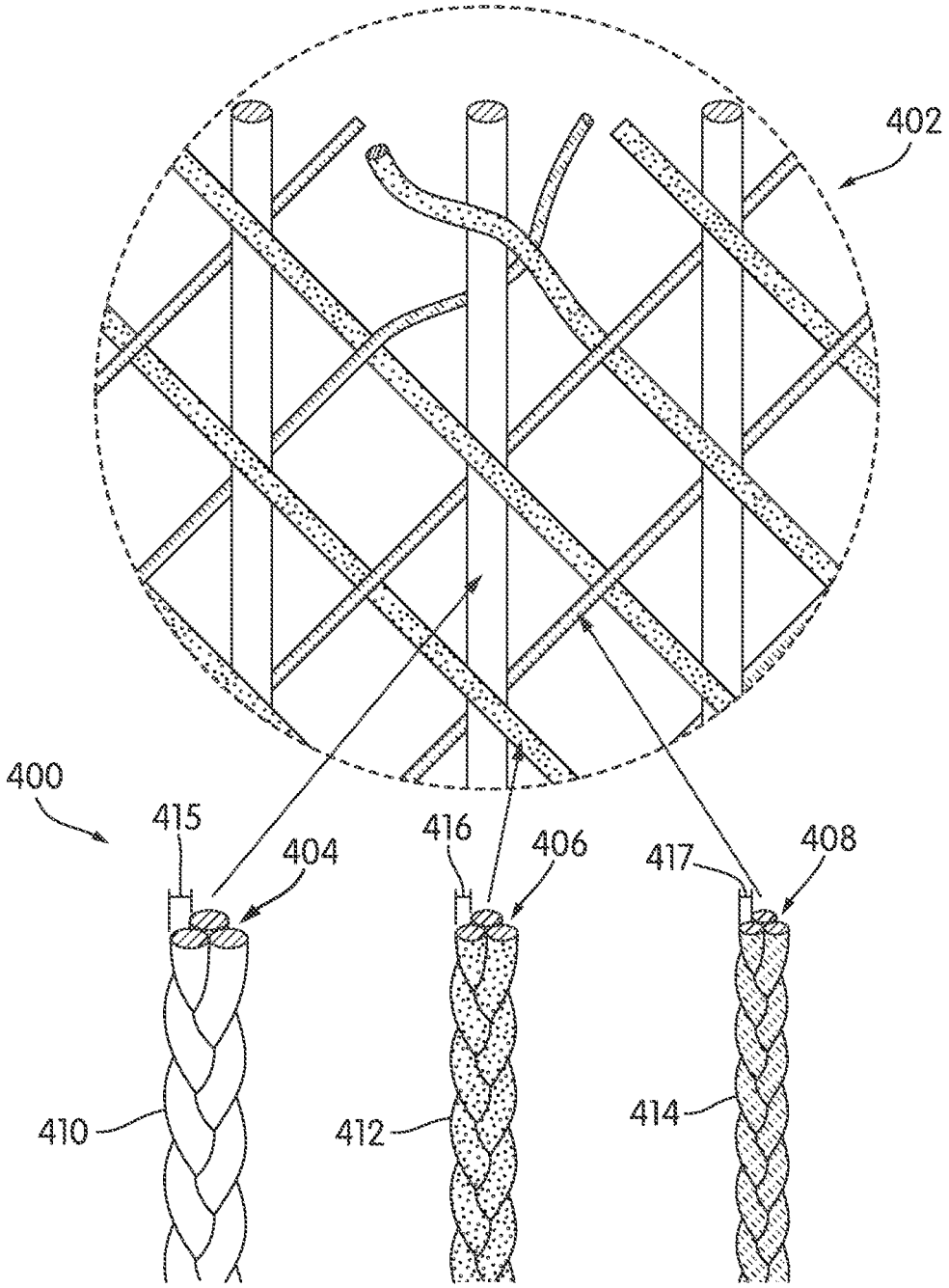
FIG. 6 is schematic view of an embodiment of different braided strands with different cross-sectional diameter sizes with an enlarged view of a braided structure.

FIG. 6, illustrates an embodiment of various combinations of braided strands braided to produce a larger braided structure. Using the concepts discussed above, a braided structure or braided upper may be formed by braiding a group of braided strands formed from different tensile elements 400 with different cross-sectional diameter sizes. That is, the tensile elements may have the same shape, (e.g. circular) however they may have different cross-sectional diameter sizes. Therefore, the braided structure formed by a group of braided strands with varying cross-sectional diameter sizes may not be uniform and may differ along different regions of the braided upper. It is to be understood that in still some other embodiments, braided strands may be constructed from tensile elements that may have differing cross-sectional diameter sizes and also are of a different material.

Referring to FIG. 6, in one embodiment, braided structure 402 may comprise of first braided strand 410, second braided strand 412, and third braided strand 414. First braided strand 410 may be constructed from first tensile elements 404. Second braided strand 412 may be constructed from second tensile elements 406. Third braided strand 414 may be constructed from third tensile elements 408. In some embodiments, the diameter size of the tensile elements used to produce the braided strands may vary. For example, in some embodiments, first tensile elements 404 may each have a first diameter size 415 that is larger than the diameter sizes of second tensile elements 406. Second tensile elements 406 may each have a second diameter size 416 which in turn is different than the diameter sizes of third tensile elements 408. Third tensile elements 408 may each have a third diameter size 417 that is less than first diameter size 415 and second diameter size 416. In an exemplary embodiment, first diameter size may range from 50 micrometers to 100 micrometers. Second diameter size may range from 30 micrometers to 50 micrometers. Third diameter size may range from 10 micrometers to 30 micrometers. In some other embodiments, the cross-sectional diameter sizes of tensile elements may be different.

In still some other embodiments, the number of first tensile elements 404 used to produce first braided strand 410 may differ from the number of second tensile elements 406 used to produce second braided strand 412 which may differ from the number of third tensile elements 408 used to produce third braided strand 414. Thus, the sizes, or cross-section diameters of each of the braided strands may differ with respect to each other. The varying size diameters of the braided strands may provide braided structure 402 with greater density in areas where needed, and less density in areas where desired.

In some embodiments, a braided structure can be formed using a biaxial braid, as discussed above. Forming a braided structure with braided strands arranged in a biaxial braid as opposed to a triaxial braid may impart a lighter structure because of the absence of the axial component.

Figure 7:
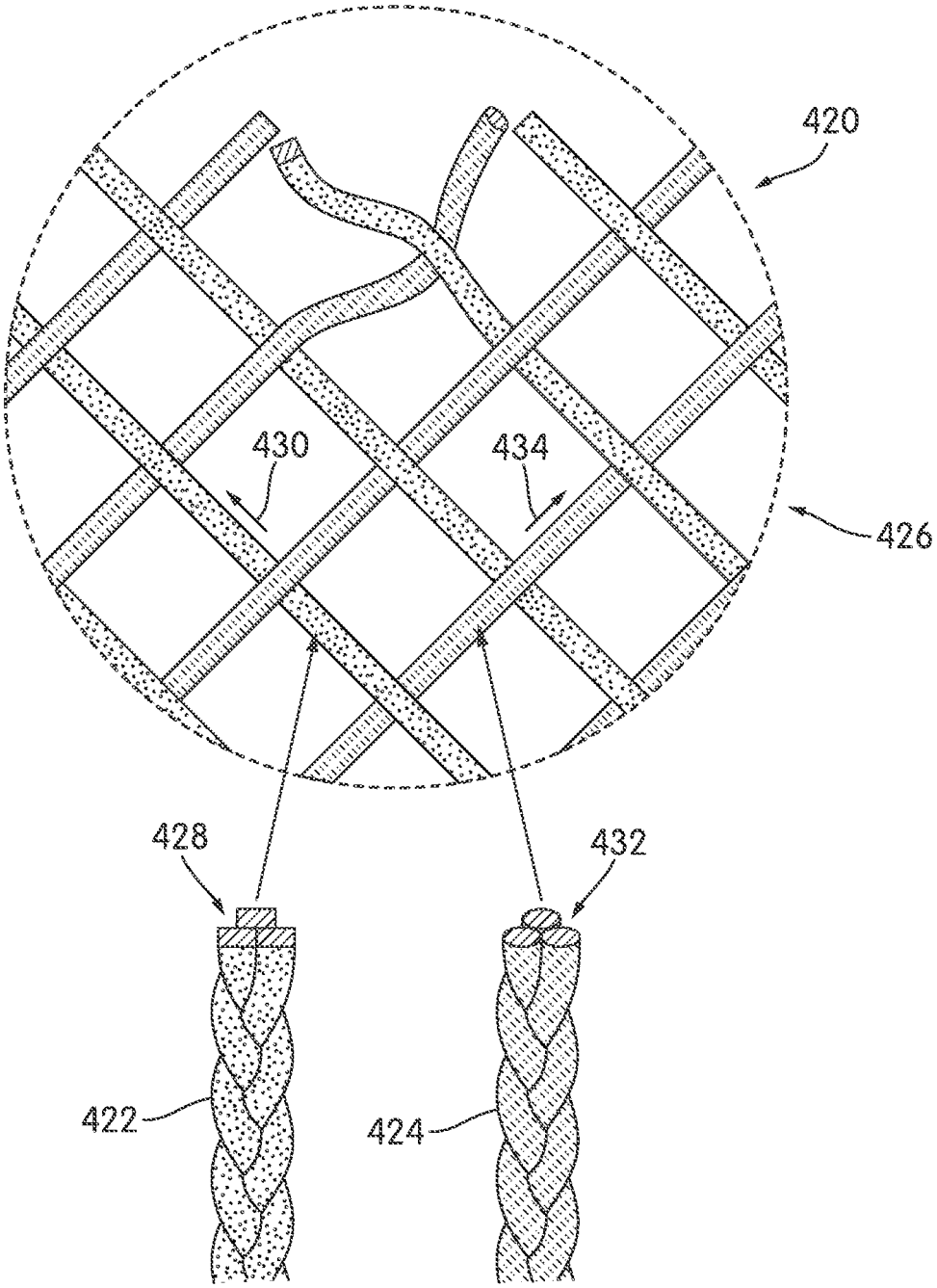
FIG. 7 is a schematic view of an embodiment of different braided strands with different cross-sectional shapes with an enlarged view of a braided structure having a biaxial braid.

Referring to FIG. 7, in one embodiment, braided structure 420 is formed by braiding first braided strand 422 with second braided strand 424 in a biaxial braid 426. As illustrated, first braided strand 422 may comprise of first tensile elements 428 which have square cross-sectional shapes. First braided strand 422 may be further oriented in a first direction 430. Second braided strand 424 may comprise of second tensile elements 432 which have circular cross-sectional shapes. Second braided strand 424 may be further oriented in a second direction 434. In some embodiments, first braided strand 422 oriented along first direction 430 may be at a bias angle relative to second braided strand 424 oriented along second direction. In one embodiment, the bias angle is 45 degrees. Further, as noted above, first tensile elements 428 and second tensile elements 430 may also have different material properties. For example, first tensile elements 428 may be more elastic than second tensile elements 430.

Some embodiments may include provisions for constructing a braided upper with tensile elements comprising multiple components. In some embodiments, a braided structure can be formed from tensile elements where the tensile elements are not singular tensile elements but multi-component elements. In some other embodiments, tensile elements may undergo a heating process to change the physical properties of the tensile elements prior to forming a braided strand.

Figure 8:
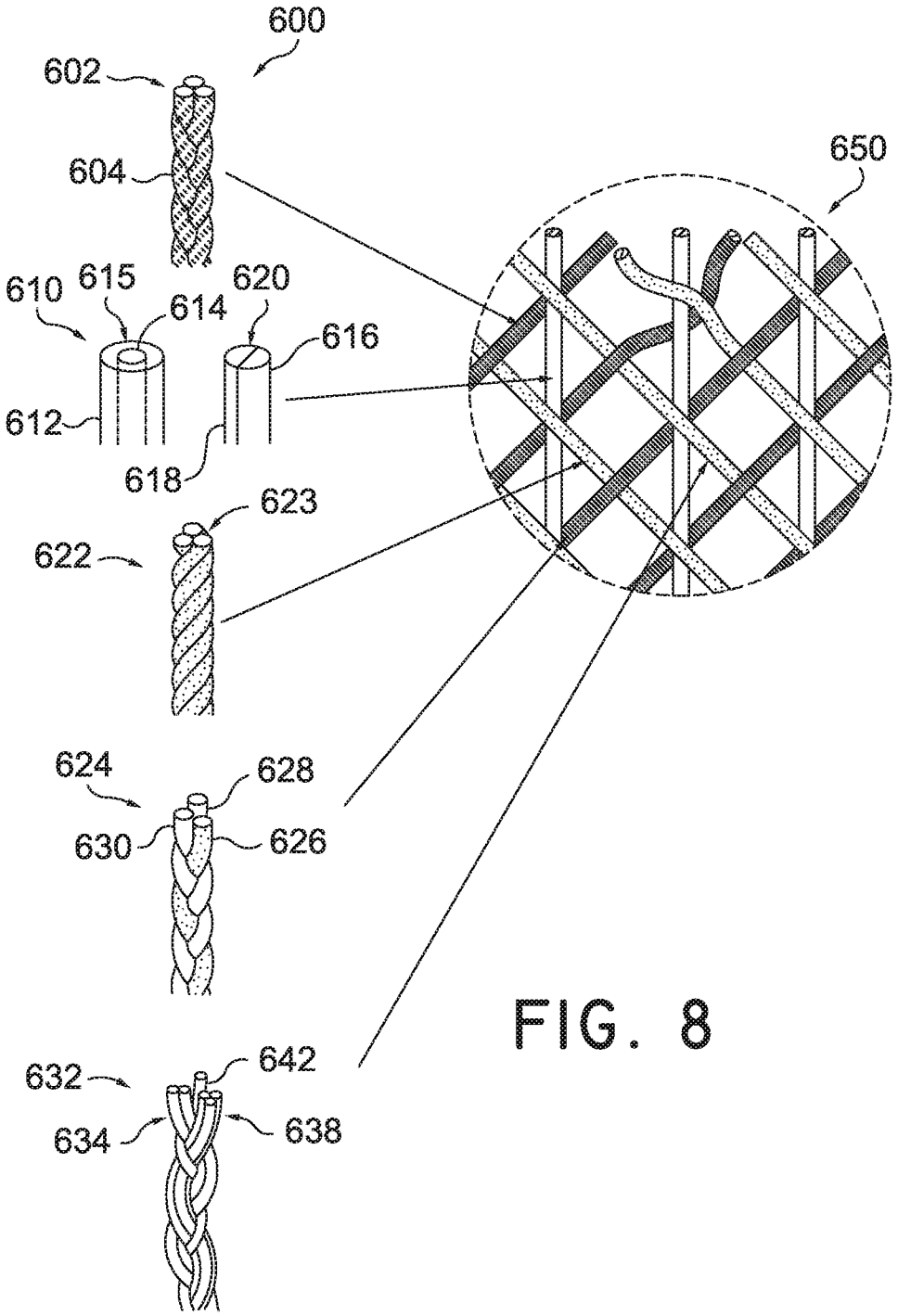
FIG. 8 is a schematic view of different embodiments of multiple tensile elements that may be used to form a braided structure.

Referring to FIG. 8, in some embodiments, multiple tensile elements 600 may be used in forming braided strands to produce a braided structure. In some embodiments, multiple tensile elements 600 may include first multiple tensile elements 602 formed into a typical braided strand 604 previously discussed above. Braided strand 604 may then be braided with other multiple tensile elements 600 to form braided structure 650.

In some other embodiments, multiple tensile elements 600 may include second multiple tensile elements 610 comprised of bi-component yarns. In some embodiments, bi-component yarns may include a tensile element with a sheath/core configuration, where sheath component 612 encloses a core component 614 forming a sheath/core structure 615. In some other embodiments, sheath/core structure 615 may be a coaxial embodiment. For example, sheath component 612 may be an outer member that coats core component 614. Core component 614 may be a separate material that is different from sheath component 612 which may be any coating known in the art.

In another embodiment, bi-component yarns may comprise of tensile elements having side-by-side configuration, where a first side component 616 is disposed adjacent to a second side component 618 to form a single unitary side-by-side structure 620. In some cases, first side component 616 may be a different material than second side component 618.

In some embodiments, second multiple tensile elements 610, whether they are sheath/core tensile structure 615, a coaxial embodiment structure, and/or side-by-side structure 620 may then be used to form braided structure 650.

In another embodiment, multiple tensile elements 600 may include third tensile elements 622 comprising of hybrid yarns. Hybrid yarns may include at least three tensile elements 623 that are twisted, or non-braided, together as shown. The third tensile elements 622, after being twisted together, may then be used to produce braided structure 650.

In some other embodiments, multiple tensile elements 600 used in forming braided structure, may include fourth tensile elements 624. Fourth tensile elements 624 may comprise of fusible or thermoplastic yarns. Fusible yarns may include a plurality of tensile elements that have been braided together and then heated within a desired temperature range known in the art. In one embodiment, fusible yarn may include first fusible element 626, second fusible element 628, and third fusible element 630. When heated, first fusible element 626, second fusible element 628, and third fusible element 630 are fused in a braided configuration to form a braided strand. The braided strand may then be used to produce braided structure 650.

In still another embodiment, multiple tensile elements 600 used in forming a braided structure, may include fifth multiple tensile elements 632. Fifth multiple tensile elements 632 may comprise of first direction tensile elements 634, some of which are arranged in a parallel formation in a first direction prior to being braided with second tensile elements 638 which are arranged in a parallel formation in a second direction. This is in contrast with previously discussed braided strands where singular tensile components are arranged in a first and second direction as explained above. In some embodiments, fifth multiple tensile elements 640 may include an axial tensile element 642.

Figure 9:
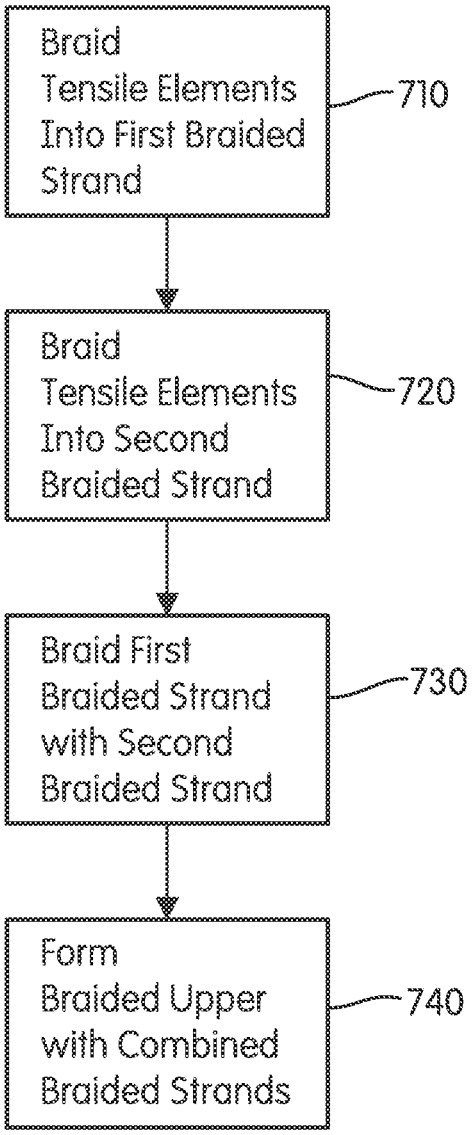
FIG. 9 is a schematic view of a process of forming a braided upper from different braided strands.

FIG. 9 illustrates a generic process for forming a braided upper. In some embodiments the following steps may be performed by a control unit (not shown) associated with a braiding process. In some other embodiments, these steps may be performed by additional devices such as an over-braiding device. It will be understood that in other embodiments, one or more of the following steps may be optional, or additional steps may be added.

During step 710, a first braided strand is created. In some embodiments, the first braided strand may be created using some of the concepts discussed above. For example, in some embodiments, the first tensile elements having a square cross-sectional shape may be used to form first braided strand. In some other embodiments, first tensile elements may have different physical property relating to a first type of material.

In step 720, a second braided strand is created that is different from the first braided strand created in step 710. As discussed above, the second braided strand may be different from the first braided strand in terms of material properties, cross-sectional shape, cross-sectional diameter size, etc. Further, in some embodiments, the second braided strand may different by using tensile elements arranged in a non-braided arrangement as illustrated in FIG. 8.

In step 730, in some embodiments, the first braided strand is then braided with the second braided strand. In some other embodiments, a third braided strand may be combined with the first and second braided strand. In some embodiments, third braided strand may be different from the first and second braided strand using the concepts previously discussed.

In step 740, a braided upper is constructed using multiple braided strands constructed in the previous steps. Some embodiments may utilize an over-braiding technique to manufacture some or all of a braided upper. For example, in some cases, an over-braiding machine or apparatus may be used to form a braided upper. Specifically, in some cases, a footwear last may be inserted through a braiding point of a braiding apparatus, thereby allowing one or more layers of a braided material to be formed over the footwear last. These concepts will be further explained in detail below.

Figure 10:
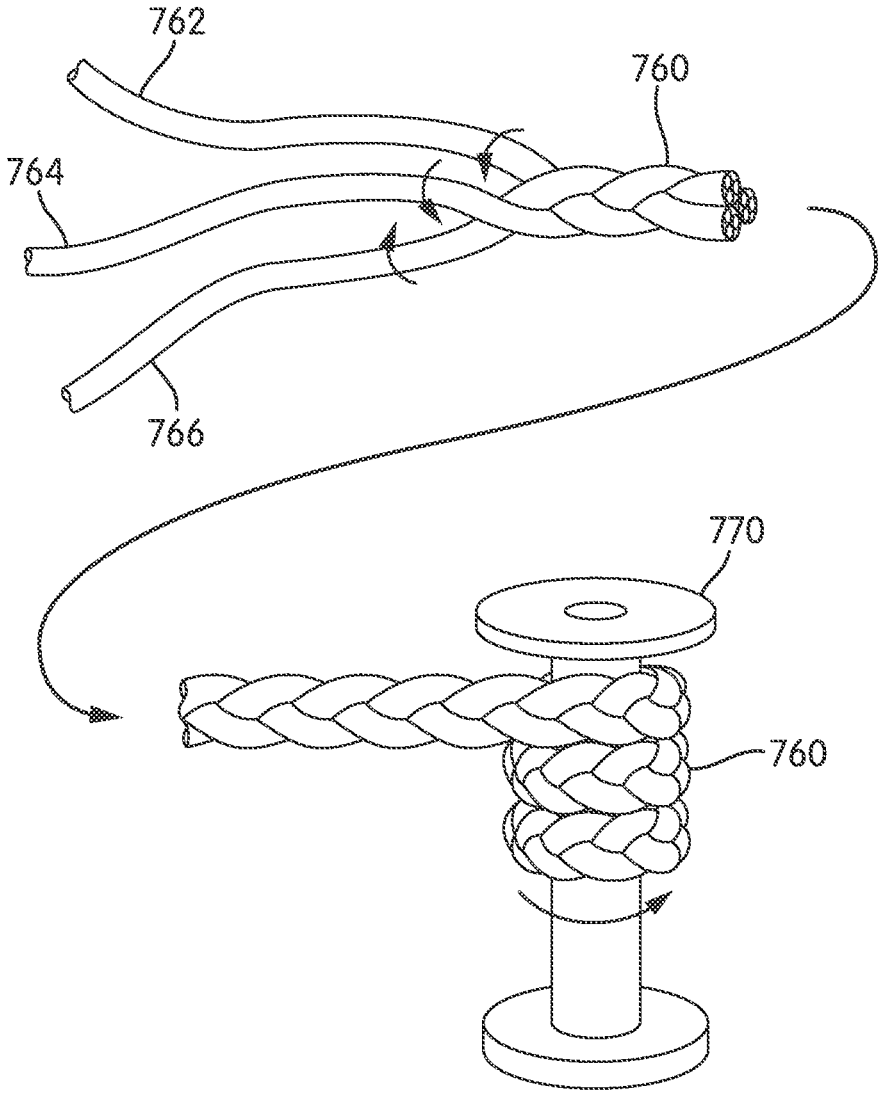
FIG. 10 is a schematic view of a braided strand being configured onto a spool component.

After the group of tensile elements have been braided into a braided strand, the braided strand may then be wound onto a spool component in preparation of forming a braided structure. Referring to FIG. 10, in one embodiment, braided strand 760 is formed from a group of tensile elements. Specifically, first tensile element 762, second tensile element 764, and third tensile element 766 are interbraided to form braided strand 760. Braided strand 760 is then wound onto spool component 770 which can then be used in an over-braiding device to form a braided structure.

Figure 11:
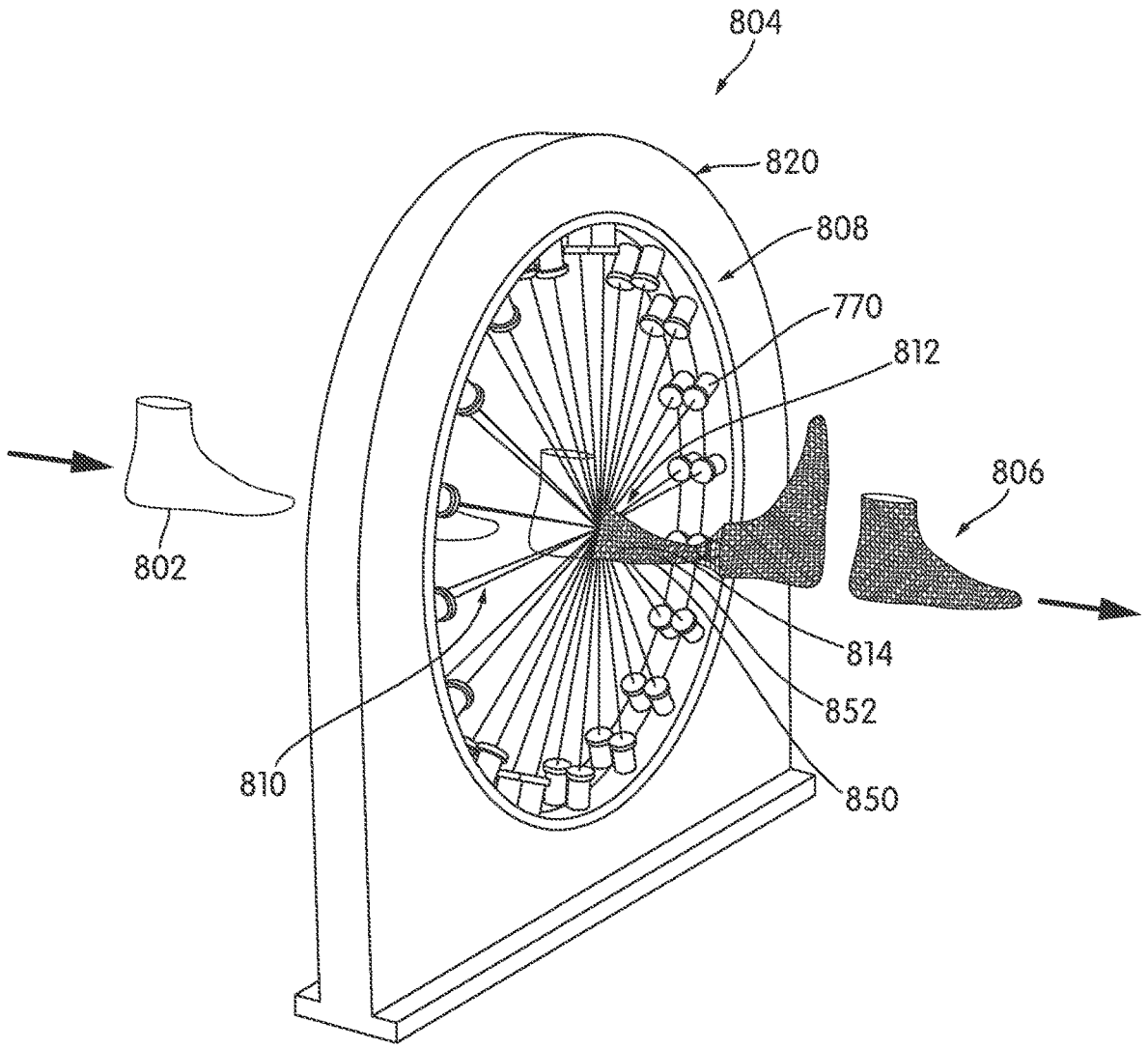
FIG. 11 is a schematic isometric view of a last inserted through a braiding device, with spool components configured with braided strands, to form a braided upper.

Referring to FIG. 11, the step of inserting a last 802 through an over-braiding device 804 to form a braided upper 806 is illustrated. Generally, an over-braiding device may be any machine, system and/or device that is capable of applying one or more braided strands, or multi-component elements over a footwear last or other form to form the braided structure. Braiding machines may generally include spools, or bobbins, that are moved or passed along various paths on the machine. As the spools are passed around, braided strands extending from the spools towards a center of the machine may converge at a "braiding point" or braiding area. Braiding machines may be characterized according to various features including spool control and spool orientation. In some braiding machines, spools may be independently controlled so that each spool can travel on a variable path throughout the braiding process, hereafter referred to as "independent spool control". Other braiding machines, however, may lack independent spool control, so that each spool is constrained to travel along a fixed path around the machine. Additionally, in some braiding machines, the central axes of each spool point in a common direction so that the spool axes are all parallel, hereby referred to as an "axial configuration". In other braiding machines, the central axis of each spool is oriented towards the braiding point (e.g., radially inwards from the perimeter of the machine towards the braiding point), hereby referred to as a "radial configuration".

For purposes of clarity, over-braiding device 804 is shown schematically in the figures. In some embodiments, over-braiding device 804 may comprise of an outer frame portion 820. In some embodiments, outer frame portion 820 may house spool components 808 to include spool component 770 from FIG. 10. Spool components 808 may include a group of braided strands 810 which extend from outer frame portion 820 towards a central braiding area 812. As discussed below, a braided upper may be formed by moving last 802 through central braiding area 812.

In some embodiments, last 802 may be manually fed through over-braiding device 804 by a human operator. In other embodiments, a continuous last feeding system can be used to last 802 through over-braiding device 804. The present embodiments could make use of any of the methods, systems, process, or components for forming a braided upper disclosed in Bruce, U.S. Patent Publication Number 2015/0007451, published on Jan. 8, 2015, and titled "Article of Footwear with Braided Upper" (now U.S. patent application Ser. No. 14/495,252 filed Sep. 24, 2014), the entirety of which is herein incorporated by reference and hereafter referred to as "the Braided Upper application." Further, the present embodiments could make use of any methods, systems, process or components disclosed in Bruce, U.S. Patent Publication Number 2016/0166000, published on Jun. 16, 2016, and titled "Last System For Braiding Footwear" (now U.S. patent application Ser. No. 14/565,682 filed Dec. 10, 2014, issued on Dec. 12, 2017 as U.S. Pat. No. 9,838,253), the entirety of which is herein incorporated by reference and hereafter referred to as "the Last System Braiding application."

As shown in FIG. 11, as last 802 is fed through over-braiding device 804, a braided structure 814 forms on the surface of last 802. In some embodiments, braided structure 814 forms a unitary piece as a braided upper 806. In some embodiments, braided upper 806 will conform to the geometry and the shape of last 802. In some embodiments, once braided upper 806 has been formed on last 802, the last 802 may then be removed from braided upper 806 (not shown).

In this illustration, toe region 850 of an upper has already been formed, and over-braiding device 804 is forming forefoot region 852 of the upper. The density of the braiding can be varied by, for example, feeding toe region 850 of the last through over-braiding device 804 more slowly while toe region 850 is being formed (to produce a relatively higher density braid) than while forefoot region 852 is being formed (to produce a relatively lower density braid). In some other embodiments, the last may also be fed at an angle and/or twisted to form braided. In still some other cases, the last may also be fed through the over-braiding device two or more times in order to form more complex structures, or may alternatively be fed through two or more over-braiding devices. In some embodiments, once the over-braiding process has been completed, a braided upper may be removed from the footwear last. In some cases, one or more openings (such as a throat opening) can be cut out of the resulting over braided upper to form the final upper for use in an article of footwear.

Figure 12:
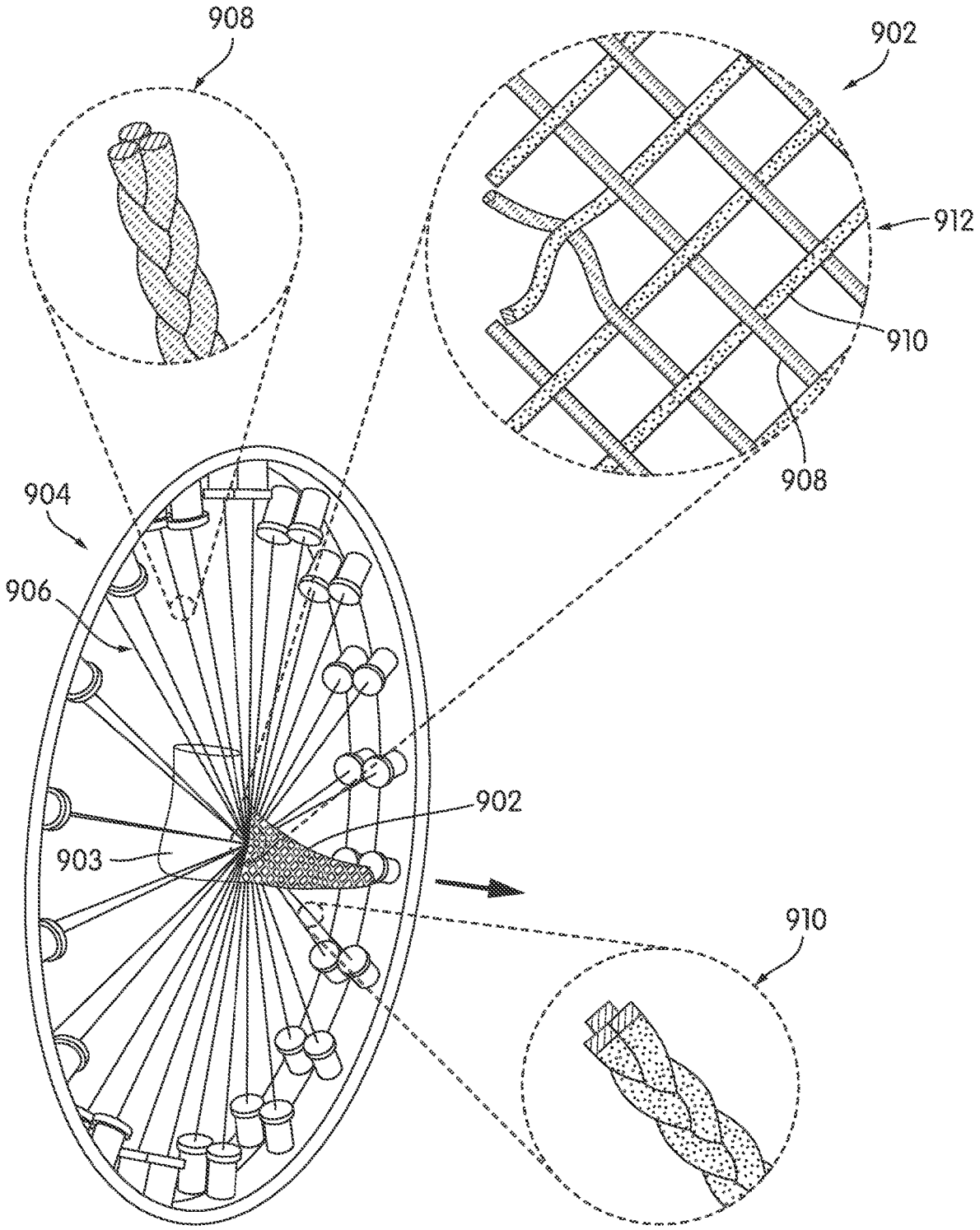
FIG. 12 is a schematic isometric view of a last inserted through a braiding device to with enlarged views of braided strands used to construct a braided upper being formed on the last.

Some embodiments may include constructing a braided upper made from a group of braided strands discussed previously. As shown in FIG. 12, in one embodiment, braided upper 902 is formed as last 903 is inserted through over-braiding device 904 configured with multiple braided strands 906. Referring to the enlarged views of FIG. 12, in one embodiment, braided upper 902 is shown being constructed from first braided strand 908 and second braided strand 910. In some embodiments, braided upper 902 may have first braided strand 908 and second braided strand 910 braided in a biaxial braided structure 912. In some other embodiments, the braided strands may have a different type of braided structure. In some cases, as explained above, first braided strand 908 and second braided strand 910 may be different in terms of having different material or physical properties of their respective tensile elements. In some other embodiments, first braided strand 908 and second braided strand 910 may be different in terms of using multiple tensile elements as shown in FIG. 8.

Figure 13:
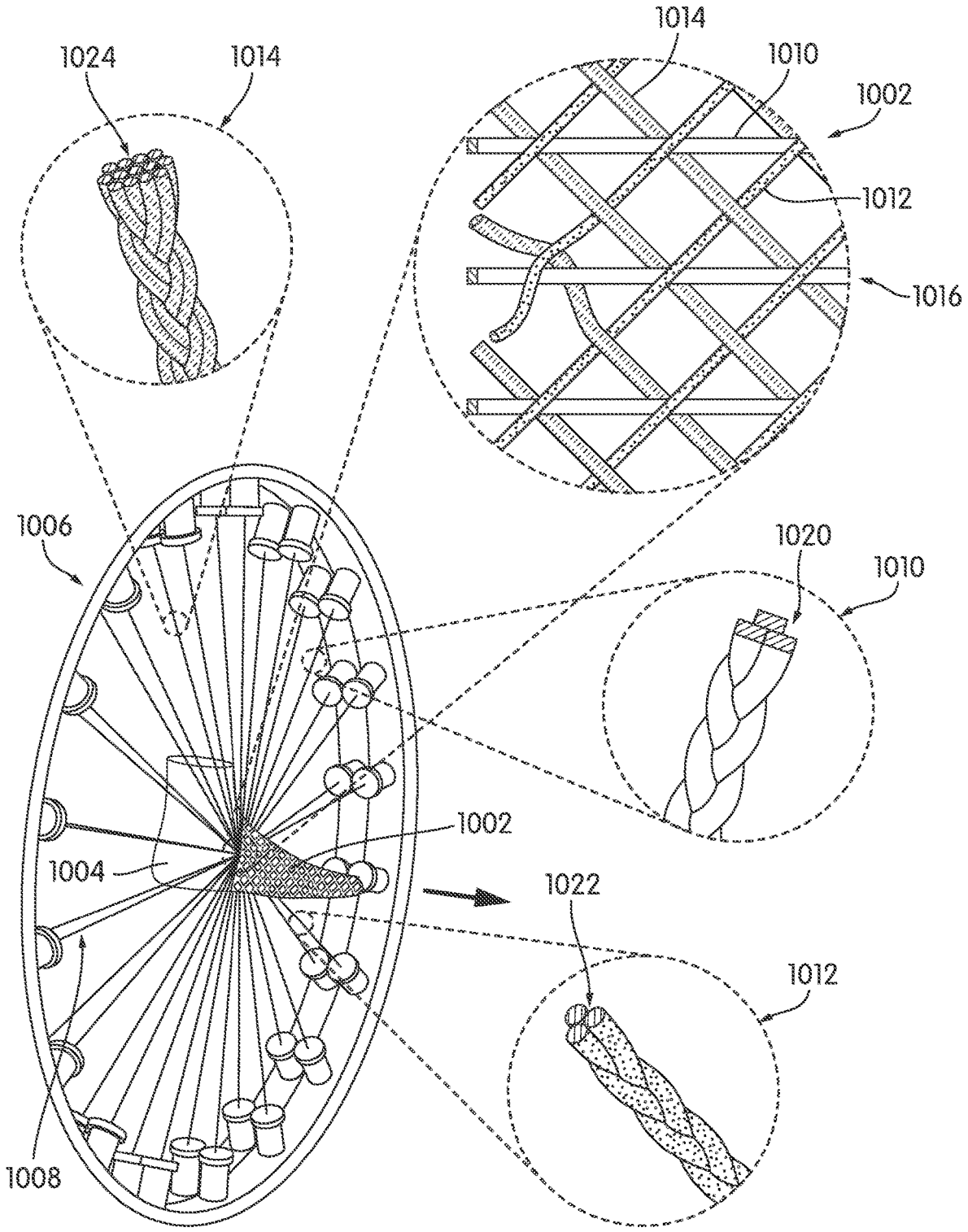
FIG. 13 is a schematic isometric view of a last inserted through a braiding device to with enlarged views of braided strands used to construct a braided upper being formed by on the last.

In some other embodiments, a braided upper may be formed from a group of braided strands, where each braided strand is composed of a different material. Referring to FIG. 13, in one embodiment, braided upper 1002 is formed as last 1004 is inserted through over-braiding device 1006 configured with a group of braiding strands 1008. As shown in the enlarged view, in one embodiment, first braided strand 1010 is interbraided with second braided strand 1012 and third braided strand 1014 in a triaxial braid 1016 to form braided upper 1002. In some embodiments, first braided strand 1010 comprised of first tensile elements 1020 may be made from a first material. In some embodiments, second braided strand 1012 comprised of second tensile elements 1022 may be made from a second material that is different from the first material. In some embodiments, third braided strand 1014, comprised of third tensile elements 1024, may be made from a third material different from first and second material. In still some other embodiments, first braided strand 1010, second braided strand 1012, and third braided strand 1014 may distinct in terms of their cross-sectional shape, or other properties as previously explained above.

While the embodiments of the figures depict articles having low collars (e.g., low-top configurations), other embodiments could have other configurations. In particular, the methods and systems described herein may be utilized to make a variety of different article configurations, including articles with higher cuff or ankle portions. For example, in another embodiment, the systems and methods discussed herein can be used to form a braided upper with a cuff that extends up a wearer's leg (i.e., above the ankle). In another embodiment, the systems and methods discussed herein can be used to form a braided upper with a cuff that extends to the knee. In still another embodiment, the systems and methods discussed herein can be used to form a braided upper with a cuff that extends above the knee. Thus, such provisions may allow for the manufacturing of boots comprised of braided structures. In some cases, articles with long cuffs could be formed by using lasts with long cuff portions (or leg portions) with a braiding machine (e.g., by using a boot last). In such cases, the last could be rotated as it is moved relative to a braiding point so that a generally round and narrow cross-section of the last is always presented at the braiding point.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. An article of footwear having a braided upper, comprising:

a first group of tensile elements having a square cross-sectional shape and braided to form a first braided strand having a first cross-sectional area;

a second group of tensile elements having a circular cross-sectional shape and braided to form a second braided strand having a a second cross-sectional area;

wherein the first braided strand is different than the second braided strand; and wherein the first braided strand oriented along a first direction is braided with the second braided strand oriented along a second direction at a bias relative to the first direction to form at least a region of the braided upper and wherein one of the first braided strand and the second braided strand is an axial component of the braided upper.

2. The article of footwear of claim 1, wherein the first cross-sectional area is different than the second cross-sectional area.

3. The article of footwear of claim 1, wherein the first group of tensile elements are made from a first material, the second group of tensile elements are made of a second material, and wherein the first material is different than the second material.

4. The article of footwear of claim 1, wherein the first group of tensile elements have a first cross-sectional diameter, the second group of tensile elements have a second cross-sectional diameter, and wherein the first cross-sectional diameter is different than the second cross-sectional diameter.

5. The article of footwear of claim 1, wherein the first group of tensile elements have a first elasticity, the second group of tensile elements have a second elasticity, and wherein the first elasticity is different than the second elasticity.

6. The article of footwear of claim 1, wherein the first group of tensile elements have a first tensile strength, the second group of tensile elements have a second tensile strength, and wherein the first tensile strength is different than the second tensile strength.

7. An article of footwear having a braided upper, comprising:

a first braided strand comprised of a first group of tensile elements having a square cross-sectional shape, wherein the first group of tensile elements are braided together to form the first braided strand having a first cross-sectional area;

a second braided strand comprised of a second group of tensile elements having a circular cross-sectional shape, wherein the second group of tensile elements are braided together to form the second braided strand having a second cross-sectional area;

wherein the first braided strand oriented along a first direction is braided with the second braided strand oriented along a second direction at a bias angle relative to the first direction to form at least a region of the braided upper; and wherein one of the first braided strand and the second braided strand is an axial component of the braided upper.

8. The article of footwear of claim 7, wherein the first group of tensile elements are made from a first material, the second group of tensile elements are made of a second material, and wherein the first material is different than the second material.

9. The article of footwear of claim 7, wherein the first group of tensile elements have a first cross-sectional diameter, the second group of tensile elements have a second cross-sectional diameter, and wherein the first cross-sectional diameter is different than the second cross-sectional diameter.

10. The article of footwear of claim 7, wherein the first group of tensile elements have a first elasticity, the second group of tensile elements have a second elasticity, and wherein the first elasticity is different than the second elasticity.

11. The article of footwear of claim 10, wherein the first group of tensile elements have a first tensile strength, the second group of tensile elements have a second tensile strength, and wherein the first tensile strength is different than the second tensile strength.

12. An article of footwear having a braided upper, comprising:

a first braided strand comprised of a first group of tensile elements having a square cross-sectional shape that are braided together to form the first braided strand having a first cross-sectional area;

a second braided strand comprised of a second group of tensile elements having a circular cross-sectional shape that are braided together to form the second braided strand having a second cross-sectional area;

wherein the first group of tensile elements are made of a first material;

wherein the second group of tensile elements are made of a second material;

wherein the first material is different than the second material; and wherein the first braided strand oriented along a first direction is braided with the second braided strand oriented along a second direction at a bias angle relative to the first direction to form at least a region of the braided upper and wherein one of the first braided strand and the second braided strand is an axial component of the braided upper.

13. The article of footwear of claim 12, wherein the first cross-sectional area is different than the second cross-sectional area.

14. The article of footwear of claim 12, wherein the first group of tensile elements have a first cross-sectional diameter, the second group of tensile elements have a second cross-sectional diameter, and wherein the first cross-sectional diameter is different than the second cross-sectional diameter.

15. The article of footwear of claim 12, wherein the first group of tensile elements have a first elasticity, the second group of tensile elements have a second elasticity, and wherein the first elasticity is different than the second elasticity.

* * * * *